US006233770B1

(12) United States Patent
Garcia

(10) Patent No.: US 6,233,770 B1
(45) **Date of Patent: *May 22, 2001**

(54) COMBINATION WRITING IMPLEMENT AND TURNING TOOL

(76) Inventor: Frank Garcia, 223 Pease Rd., Manalapan, NJ (US) 07726

( * ) Notice: Subject to any disclaimer, the term of this patent is extended or adjusted under 35 U.S.C. 154(b) by 0 days.

This patent is subject to a terminal disclaimer.

(21) Appl. No.: 09/599,747

(22) Filed: Jun. 22, 2000

(51) Int. Cl.[7] ..... B25B 15/00

(52) U.S. Cl. ..... 7/165; 7/167; 401/195

(58) Field of Search ..... 7/165, 170, 167; 401/195

(56) References Cited

U.S. PATENT DOCUMENTS

| | | | | |
|---|---|---|---|---|
| 138,528 | * | 5/1873 | Reed et al. | 7/165 |
| 2,190,910 | * | 2/1940 | Nichols | 401/195 |
| 4,761,090 | * | 8/1988 | Goh | 401/195 |
| 5,638,566 | * | 6/1997 | Wu | 7/165 |
| 5,711,043 | * | 1/1998 | Crawford et al. | 7/165 |
| 5,916,278 | * | 6/1999 | Garcia | 7/165 |

* cited by examiner

*Primary Examiner*—Joseph J. Hall, III
*Assistant Examiner*—Lee Wilson
(74) *Attorney, Agent, or Firm*—Richard L. Huff

(57) ABSTRACT

A device which contains a combination of a writing implement, stylus, or turning tool on one end and a turning tool rod on the other. The device contains a hollow casing, a forward end tip containing a central passageway for extension and retraction of a forward work piece and a rearward tip containing a central passageway for extension and retraction of a turning tool rod. The forward work piece is reversible and contains a writing point or a turning tool. The turning tool rod is reversible and contains a turning tool at each end. One device contains a single extension/extraction slot having forward, medial, and rearward openings or notches. In this alternative, the device contains actuator guide pins or latch pins which allow only the forward work piece, only the tool rod, or neither of these to be extended at any one time. Alternatively, the device contains forward and rearward extension/retraction slots, each having forward and rearward openings or notches. The forward and rearward actuator guide pins or latch pins allow independent control of the forward work piece and rearward tool rod. In another alternative, there is a rearward slot having forward, medial, and rearward openings or notches and a forward slot containing forward, intermediate and rearward positions. This alternative allows for the easy extension of a work piece holder for the reversing of the holder to use the stylus which is at its rearward end while providing for independent control of the forward work piece and rearward turning tool.

20 Claims, 21 Drawing Sheets

COMBINATION WRITING IMPLEMENT AND TURNING TOOL

CROSS-REFERENCE TO RELATED APPLICATIONS

This application is related to my earlier invention described and claimed in Ser. No. 09/003,166, filed Jan. 6, 1998, now U.S. Pat. No. 5,916,278.

BACKGROUND OF THE INVENTION

1. Field of the Invention

The present invention relates to a combined writing implement and turning tool, and more particularly, to a pen or pencil which is extendible and retractable on one end of the implement and a reversible rod which carries a Phillips head screwdriver, flat edge screwdriver, torx, Allen wrench, or other turning tool which is extendible and retractable on the other end of the implement. Alternatively, both ends may carry a turning tool, e.g. one flat head screw driver and one Allen wrench. Additionally, the end carrying the pen may be adapted to carry a carbide- or diamond-tipped stylus for keying pocket organizers or other devices which are too small to be keyed with the fingers or etching or marking glass or metal materials.

2. Description of the Related Art

The combination of writing implements and tools on the same holder is known in the art.

Nichols, in U.S. Pat. No. 2,190,910, describes an extendible/retractable writing implement which serves as a holder for a removable screwdriver. This implement has the disadvantage of requiring the removal of the screwdriver whenever its use is desired. This removal involves a plurality of steps. The separate screwdriver contains a short handle which is difficult to hold and turn and may become lost because of its small size.

Wu, in U.S. Pat. No. 5,638,566, describes a writing implement which is combined with a plurality of tools, including a Phillips head screwdriver and a flat head screwdriver. The writing implement and the tools are not extendible and retractable and remain exposed at all times. This presents the possibility of unsightly shirt pockets as the implement is intended to be carried in a shirt pocket. Also, the tool is constantly exposed and presents a danger, especially when the tool is a cutting blade. The screwdriver is attached to the casing by threads which turn when the screwdriver is used, tending to loosen the screwdriver. Any attempt to make the writing point and tools extendible and retractable would necessitate the destruction of the capability of the implement to carry a plurality of tools inside the implement.

The invention described and claimed in my earlier application, now U.S. Pat. No. 5,916,278 works well for its intended purpose. The manufacture of the patented device is more expensive than desired because of a multitude of small parts.

The present invention is designed to inexpensively provide the convenience of an extendible/retractable combination of a writing implement and a turning tool or two turning tools in a single implement while overcoming the disadvantages inherent in the implements of the prior art.

SUMMARY OF THE INVENTION

The present invention provides an implement which is a combination of a writing implement and a turning tool, a combination of a stylus and a turning tool, or a combination of two turning tools. A hollow casing contains a forward tip at one end through which a pen or pencil point, a stylus, or a tool rod may be extended or retracted. At the other end of the hollow casing is a flat surface having a non-circular opening through which a tool rod may be extended or retracted. The tool rod contains a turning tool on at least one end. This rod may be positioned such that either of the ends will be operational.

The casing contains at least one generally longitudinal slot. Each slot contains either a lateral opening or a longitudinal notch for holding an actuator guide pin, notch pin, or control button connected to an extension/retraction pin to enable the tip of the writing implement, stylus, and/or the tool rod to be extended, retracted, and held in place. Thus, with a single slot, only the forward work piece, only the rearward tool rod or neither of these will be exposed. When two slots are present, the forward work piece and the rearward tool rod may be independently moved.

In an additional embodiment, the casing contains a rearward primary longitudinal slot containing forward, medial and rearward latch openings or latch notches and a forward secondary longitudinal slot containing forward, intermediate, and rearward positions. In this embodiment, there is a forward work piece holder having an open forward end and a closed rearward end. The open forward end is used for holding an ink cartridge having a writing point on one end. The closed rearward end is tapered to a rounded point and may be used as a stylus.

With the actuator guide pin, notch pin, or control button in the medial position or forward position in the rearward primary longitudinal slot, the tool rod is retracted. With the actuator guide pin, notch pin, or control button in the rearward position of the rearward primary longitudinal slot in, the tool rod is extended.

When the control button in the forward secondary longitudinal slot is in the forward position, the forward work piece is extended allowing the forward work piece holder to be grasped and removed for easy reversal of position allowing either the stylus or ink cartridge to be operative. If the control button in the forward secondary longitudinal slot is in the rearward position, the forward work piece is retracted. If the control button in the forward secondary longitudinal slot is in the rearward position and the actuator guide pin or notch pin is moved to the forward position in the rearward primary slot, the forward work piece will be pushed forward in the forward secondary longitudinal slot so that it is in the intermediate position. In this position, the forward work piece is extended and the pen or stylus is operative.

DESCRIPTION OF THE PREFERRED EMBODIMENTS

Figure 1:
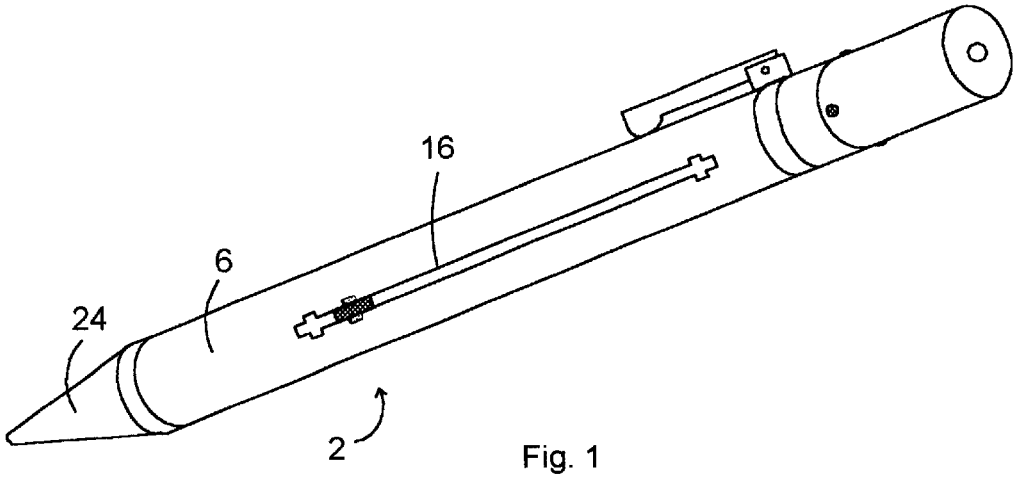
FIG. 1 is an elevational perspective view of a device according to the first preferred embodiment of this invention
Figure 2:
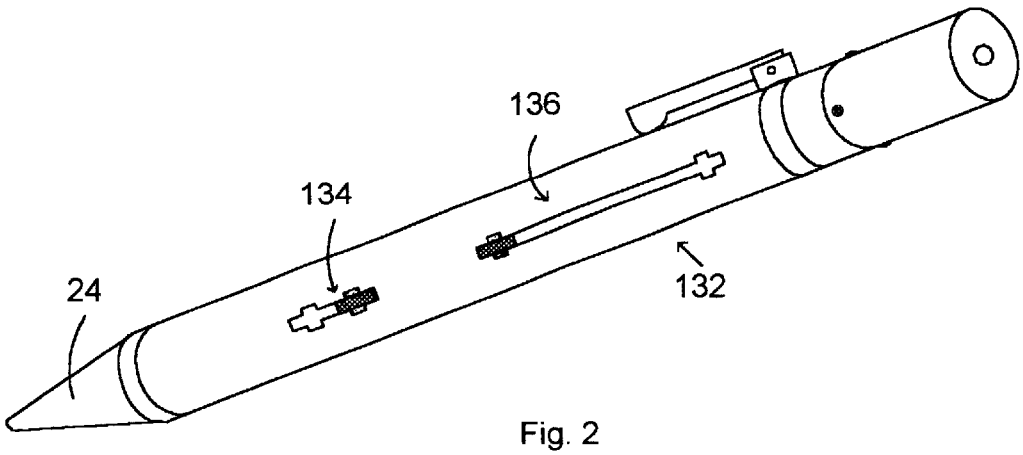
FIG. 2 is an elevational perspective view of a device according to the second preferred embodiment of the present invention.
Figure 3:
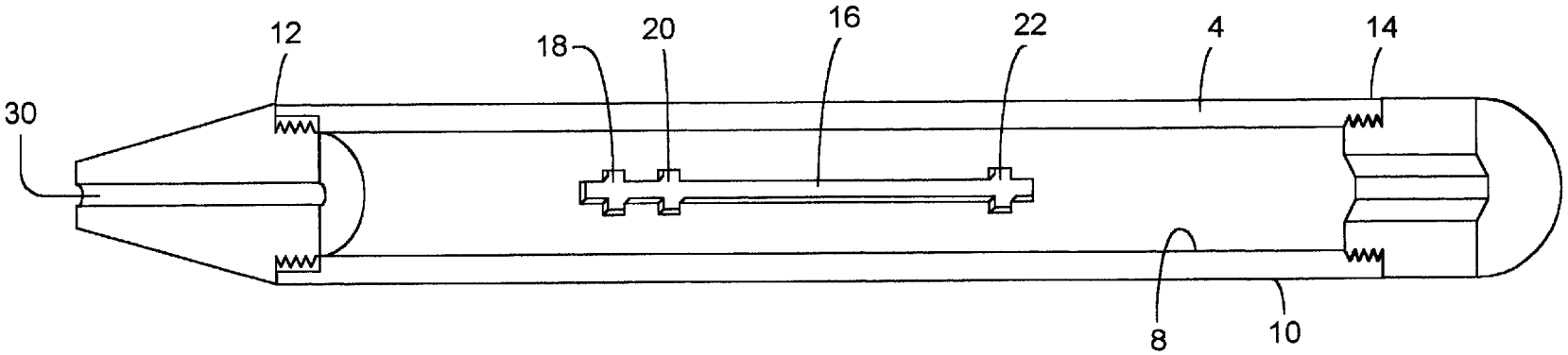
FIG. 3 is a top elevational view, partly in cut-away, of the device according to the first preferred embodiment of the present invention.
Figure 4:
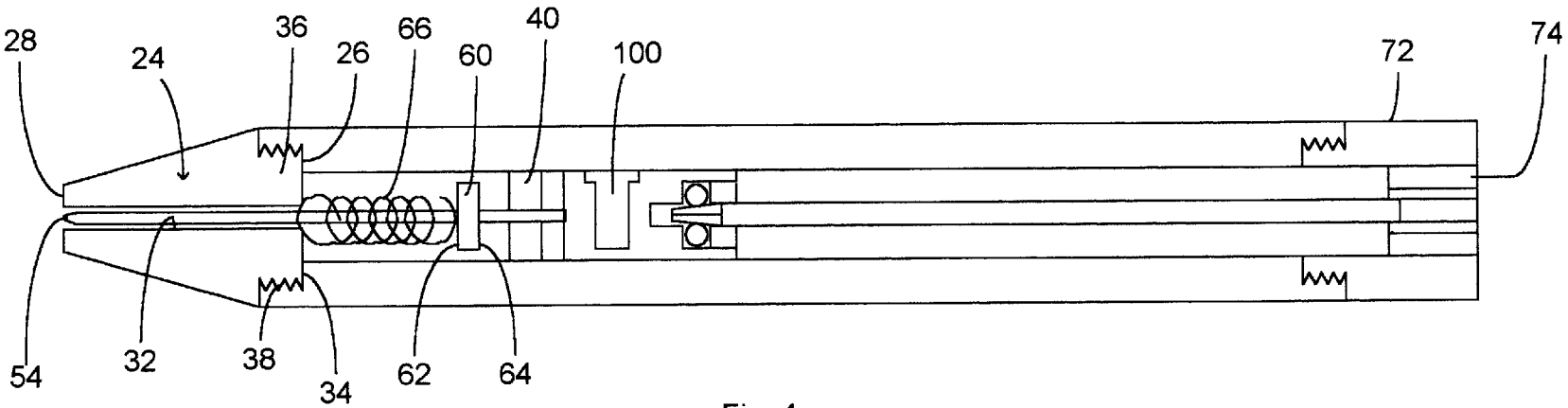
FIG. 4 is a longitudinal cross-sectional view of the device according to the first preferred embodiment of this invention.
Figure 5:
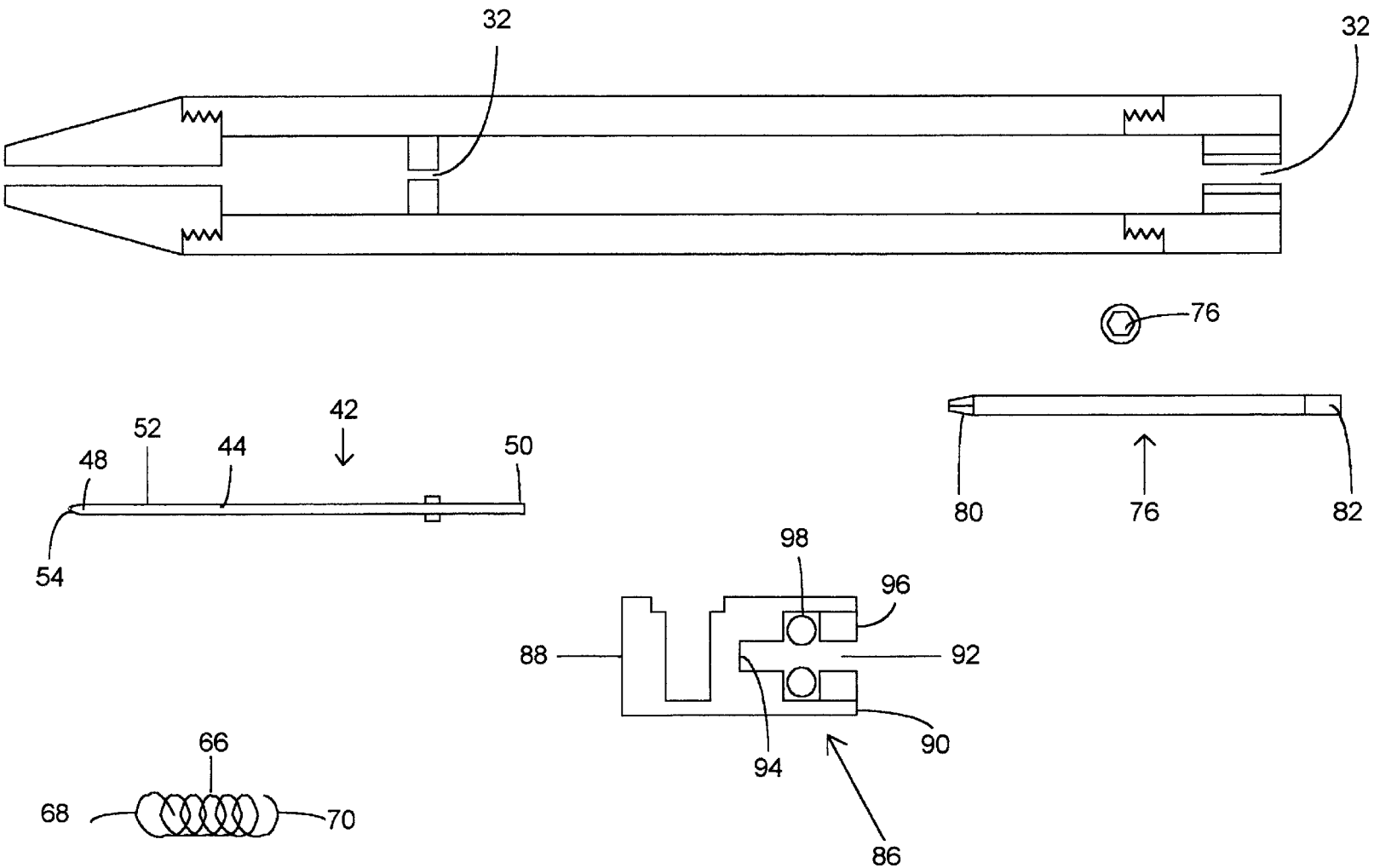
FIG. 5 is an exploded cross-sectional view of the first preferred embodiment of the present invention.
Figure 6:
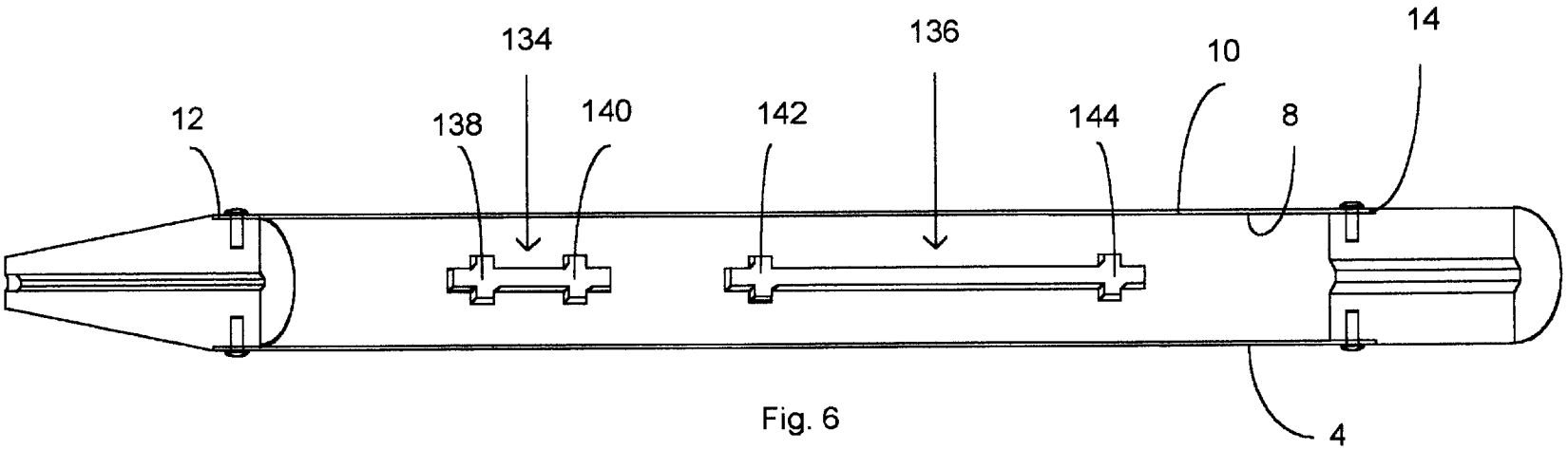
FIG. 6 is a top plan view, partially cut away, of the second preferred embodiment of this invention.
Figure 7:
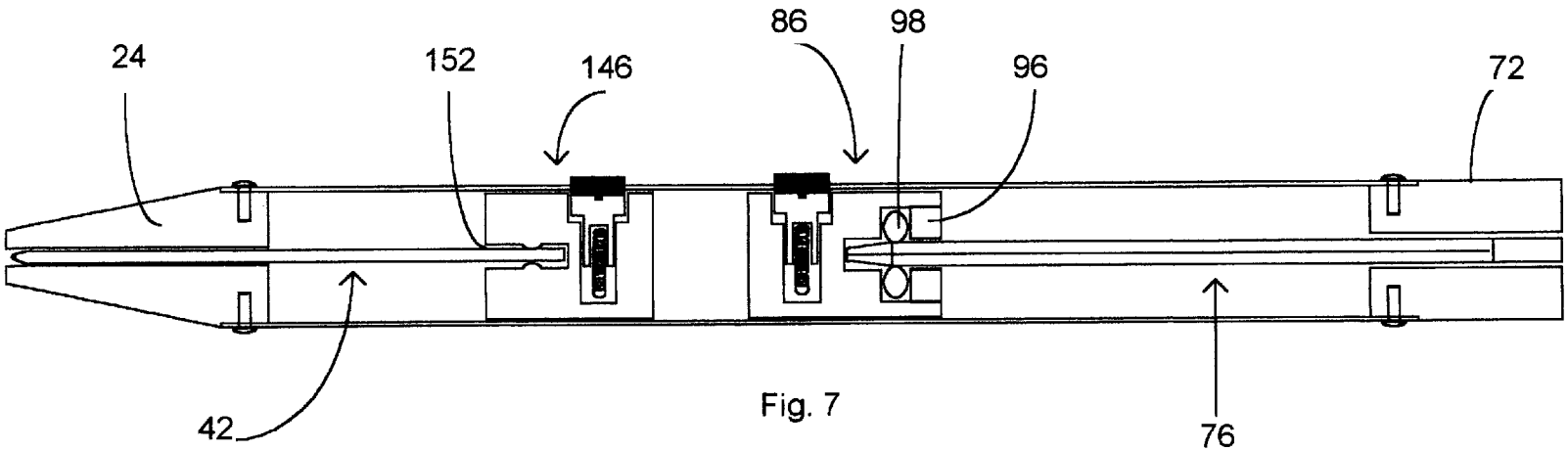
FIG. 7 is a longitudinal cross-sectional view of the second preferred embodiment of the present invention.
Figure 8:
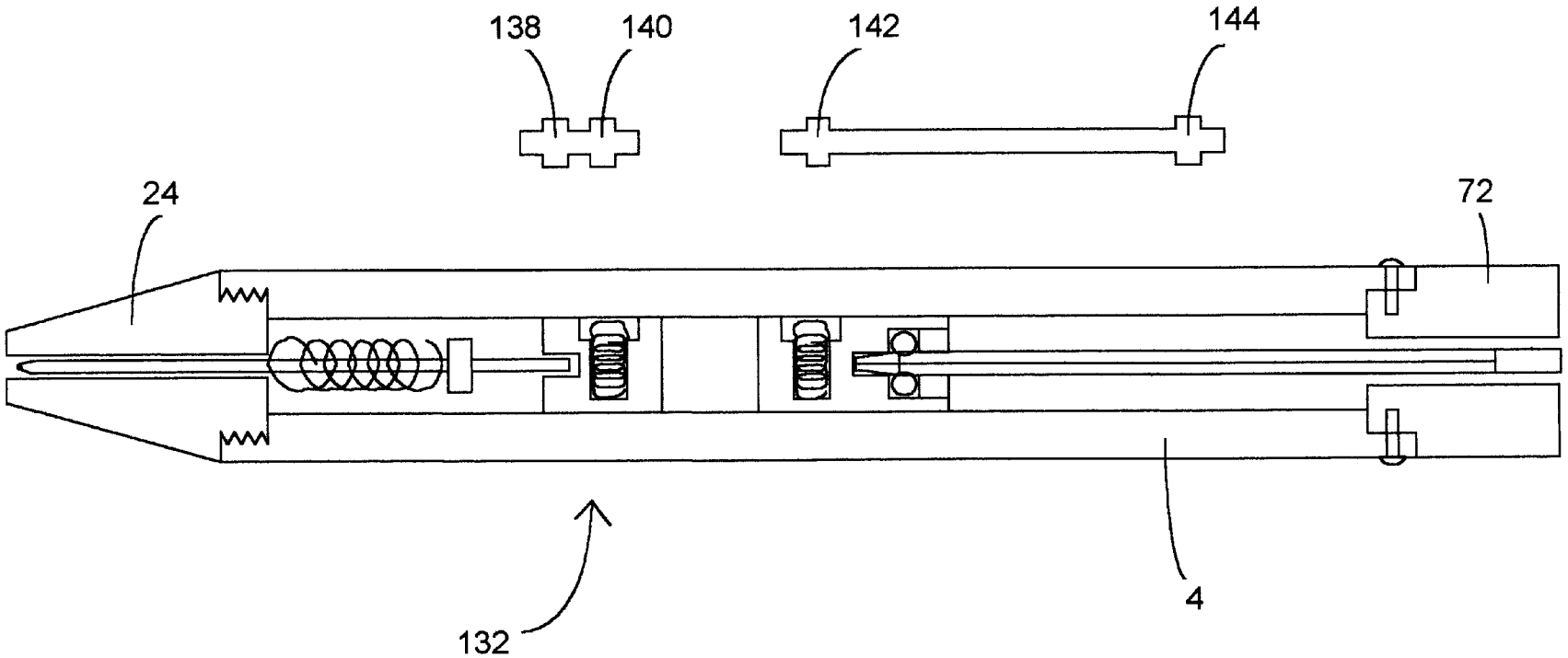
FIG. 8 is a longitudinal cross-sectional view of the second preferred embodiment of the present invention showing the corresponding longitudinal slots.
Figure 9:
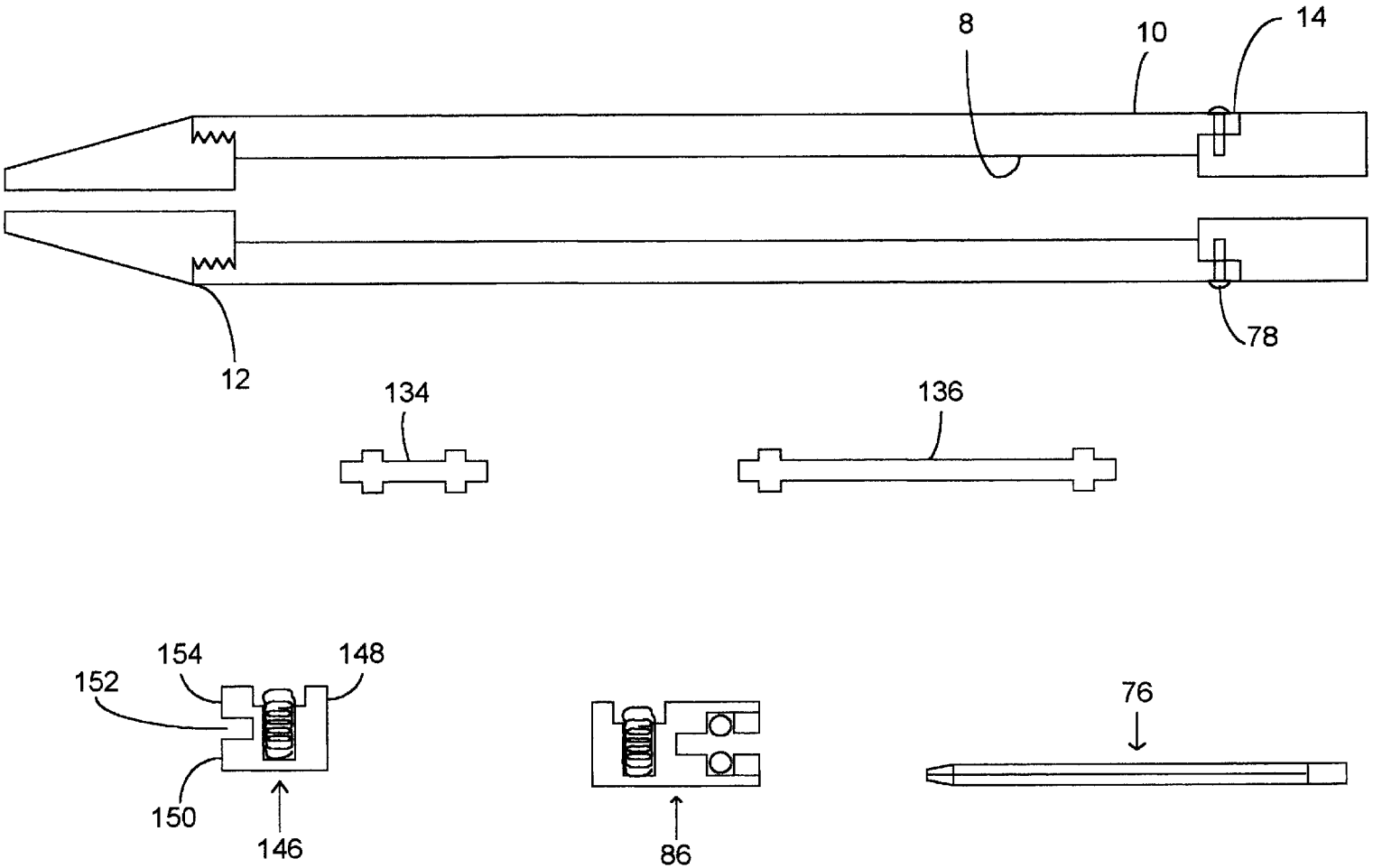
FIG. 9 is an exploded view of the second preferred embodiment of the present invention.
Figures 10, 11:
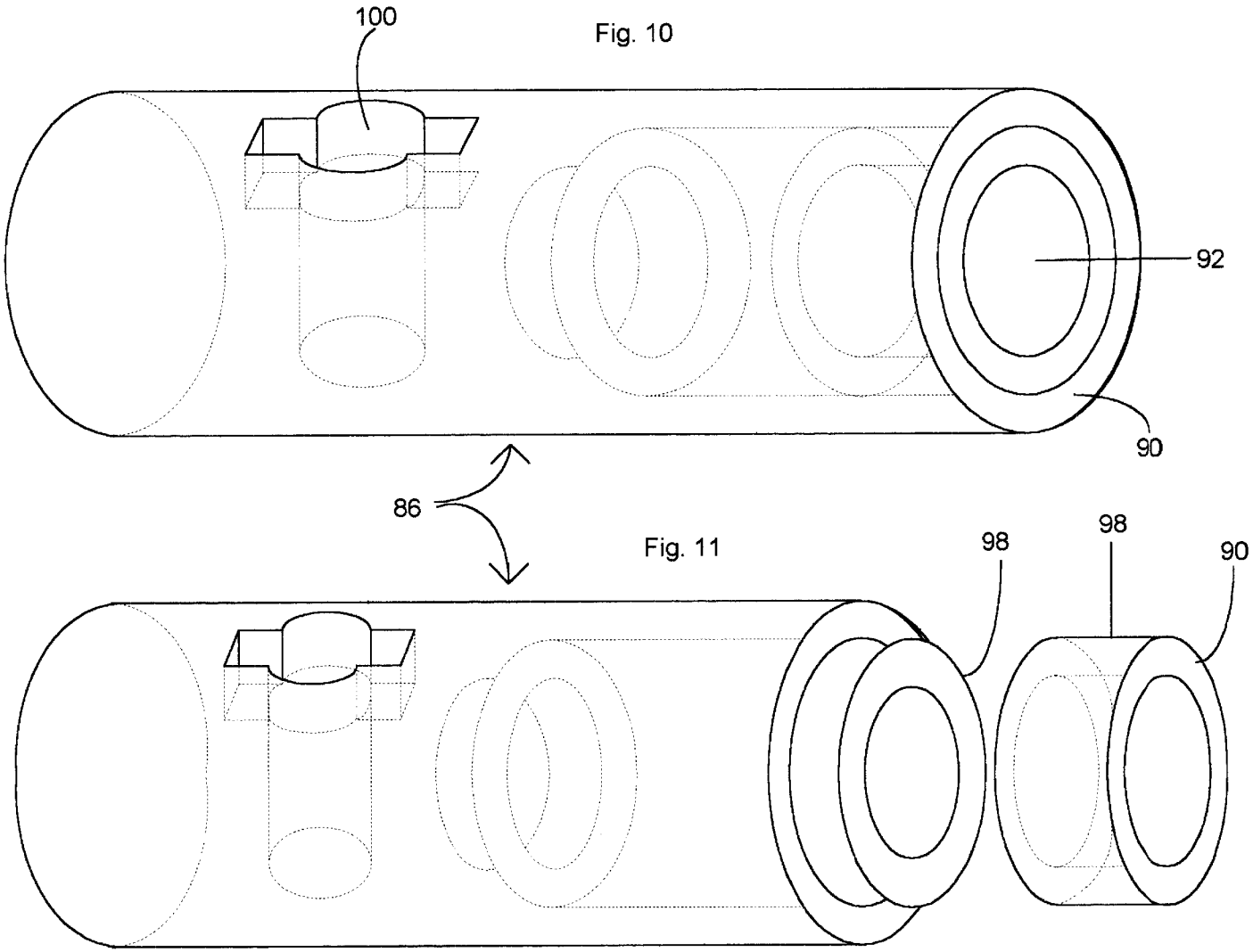
FIG. 10 is an elevational perspective view of a rearward extension/retraction pin as used in the first two preferred embodiments of the present invention.
FIG. 11 is an elevational perspective view, partly exploded, of the rearward extension/retraction pin illustrated in FIG. 10.
Figure 13:
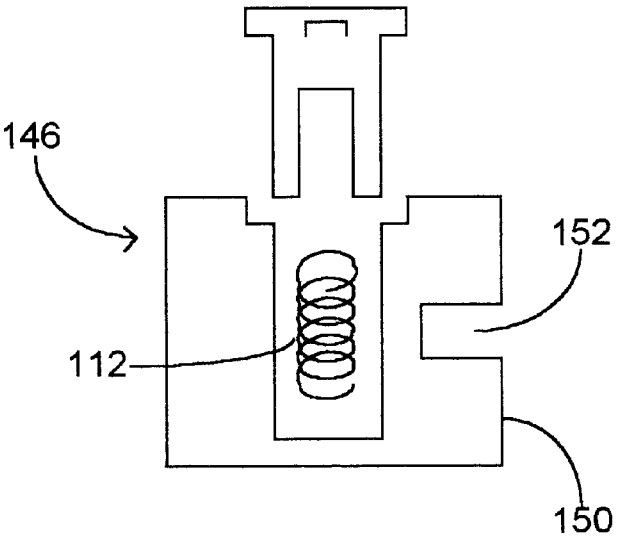
FIG. 13 is a longitudinal cross-sectional view of the forward extension/retraction pin as used in the second preferred embodiment of the present invention.
Figure 12:
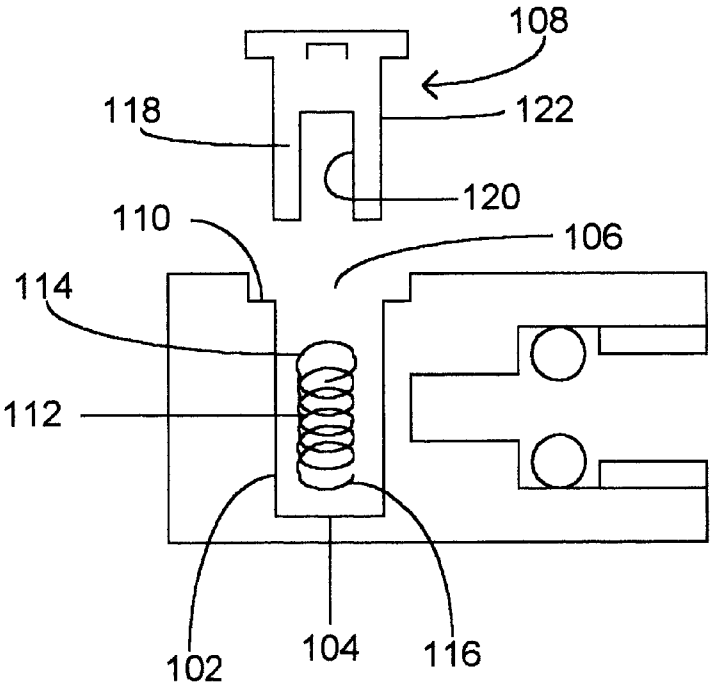
FIG. 12 is a cross-sectional longitudinal view of the rearward extension/retraction pin and actuator guide pin as used in the first two preferred embodiments of the present invention.
Figure 16:
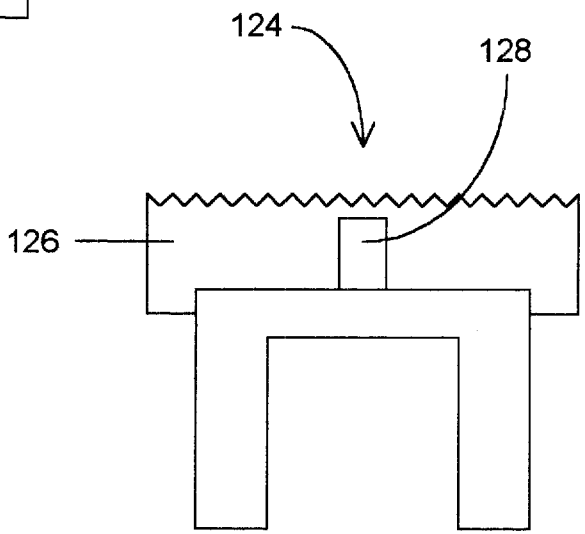
FIG. 16 is a side elevational view of a control button of the present invention.
Figure 15:
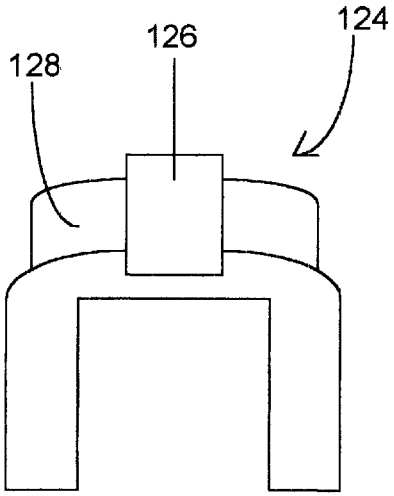
FIG. 15 is a front elevational view of a control button according to the present invention.
Figure 14:
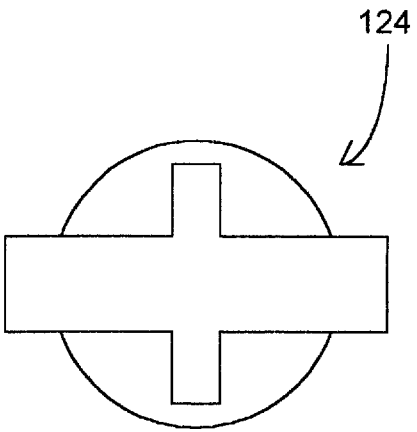
FIG. 14 is a top plan view of a control button of the present invention.
Figure 17:
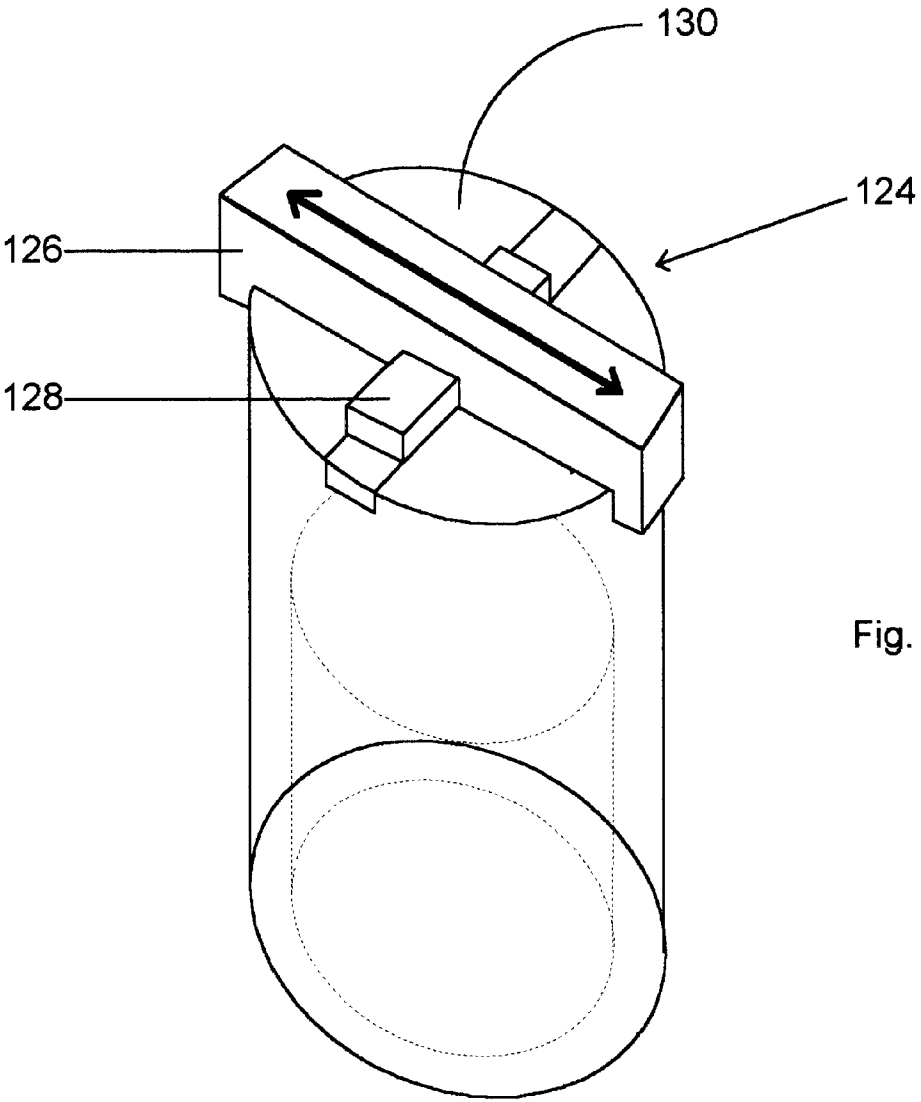
FIG. 17 is an elevational perspective view of a control button according to the present invention.
Figure 18:
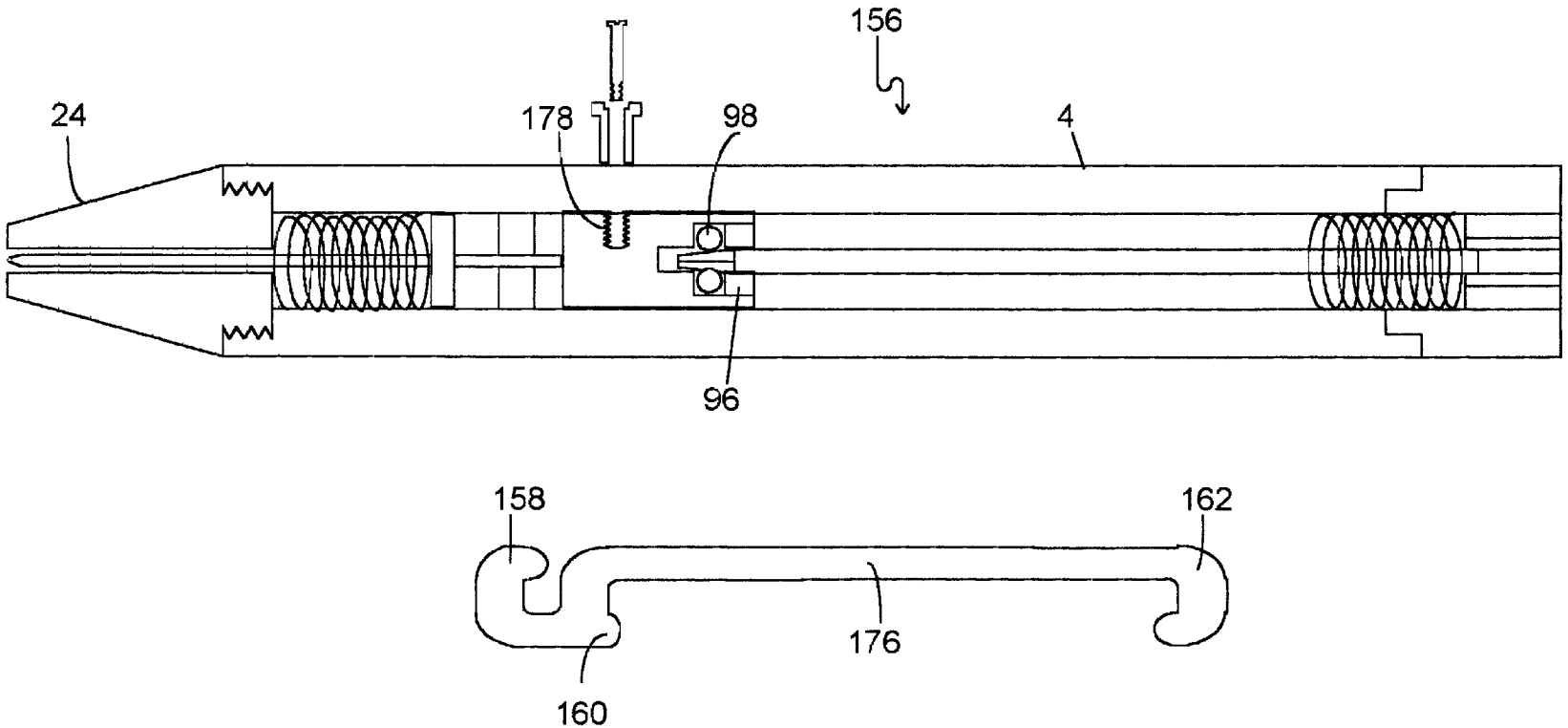
FIG. 18 is a longitudinal cross-sectional view of the third preferred embodiment of this invention showing a longitudinal slot.
Figure 19:
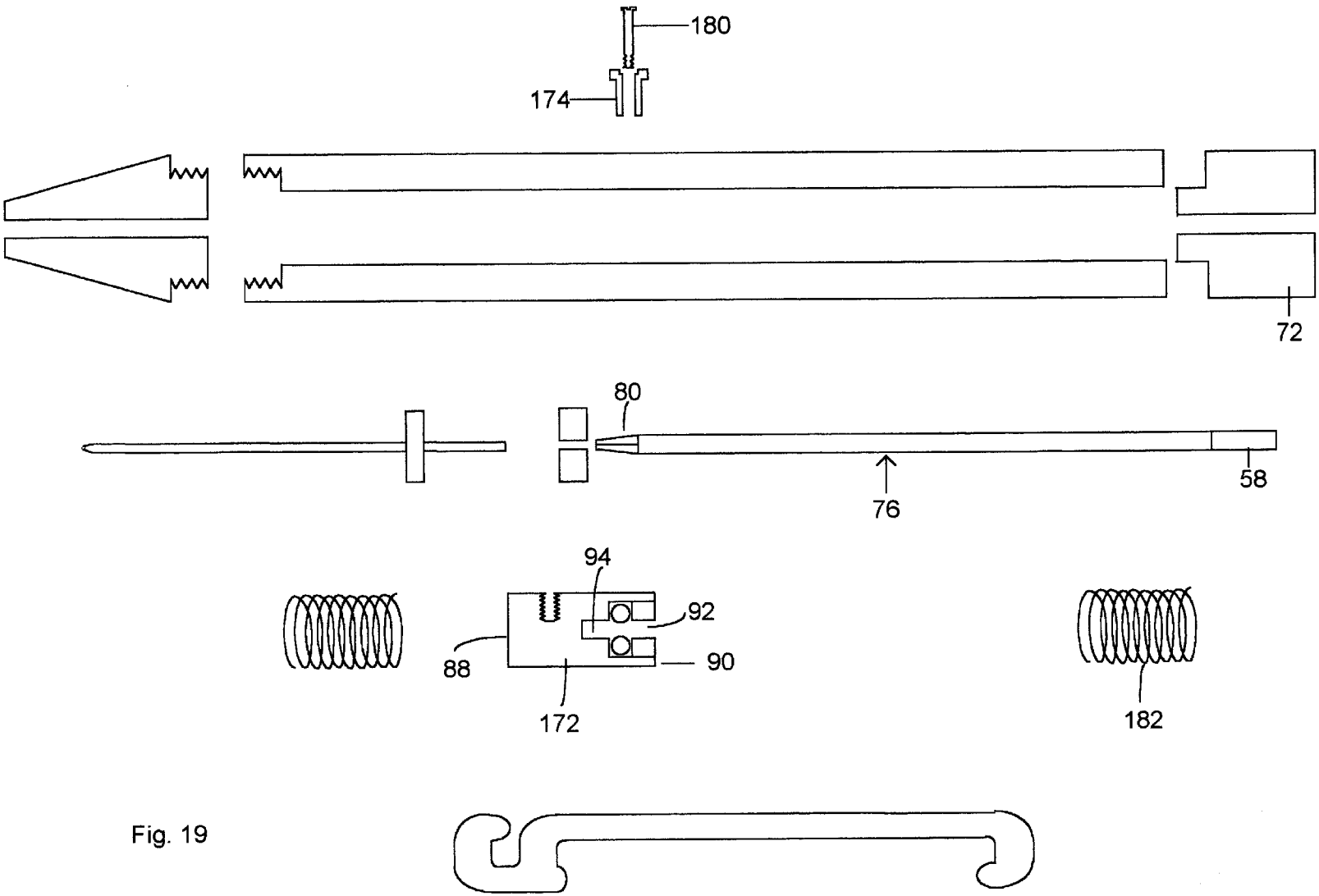
FIG. 19 is an exploded cross-sectional view of the third preferred embodiment of this invention.
Figure 20:
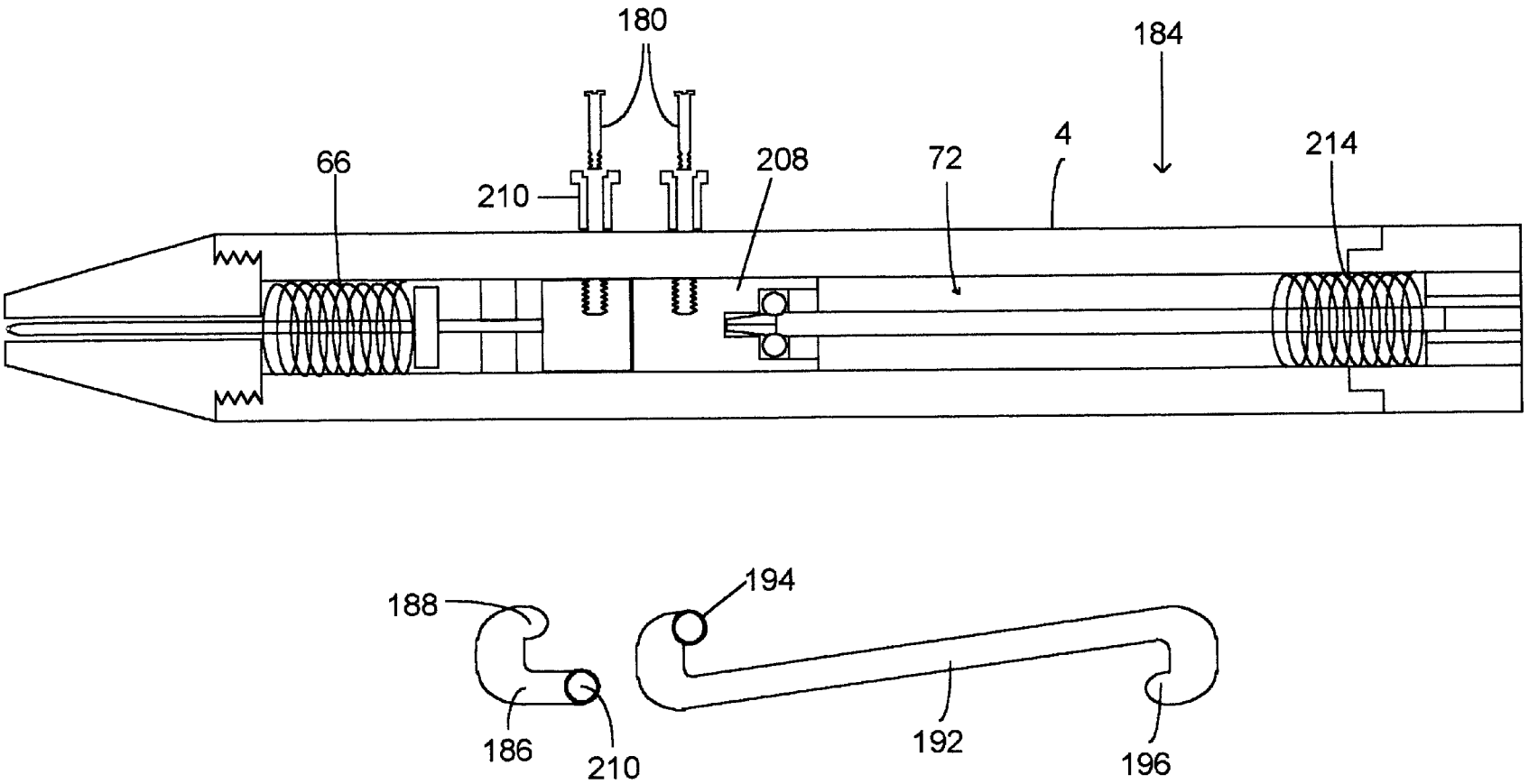
FIG. 20 is a longitudinal cross-sectional view of the fourth preferred embodiment of the invention, also showing forward and rearward longitudinal slots.
Figure 21:
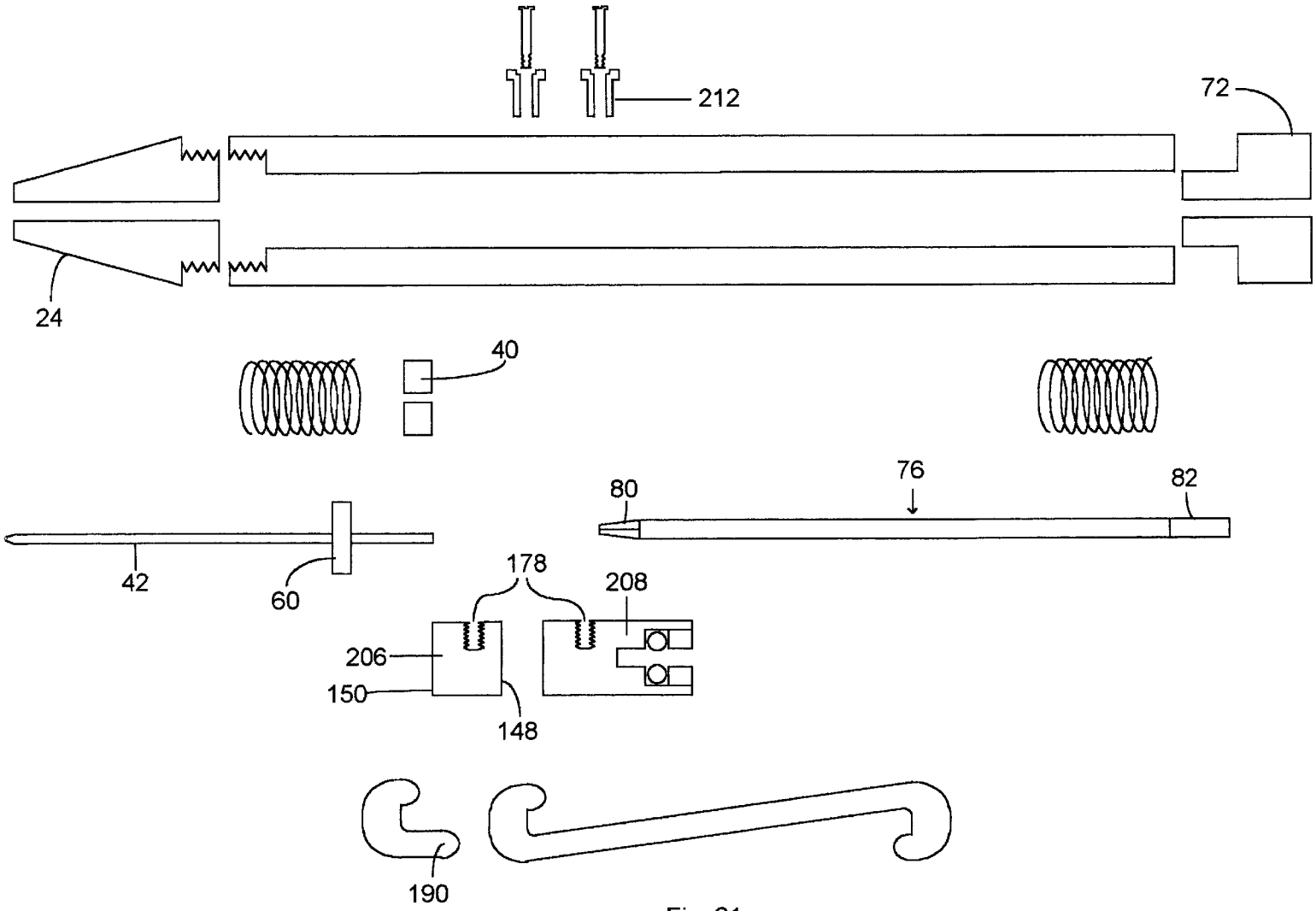
FIG. 21 is an exploded longitudinal view of the fourth preferred embodiment of this invention.
Figure 22:
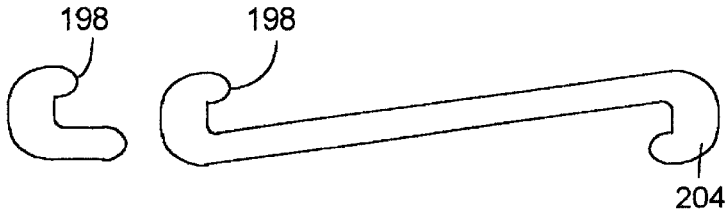
FIGS. 22–30 show alternative configurations of the longitudinal slot suitable for use in the fourth preferred embodiment of this invention.
Figure 23:
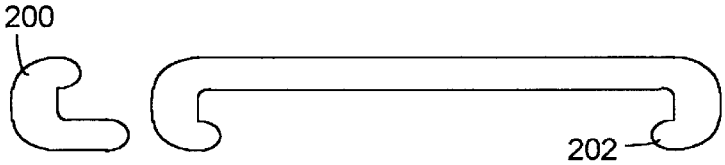
Figure 24:
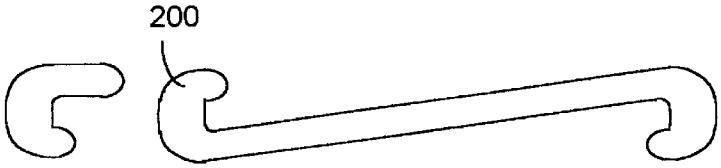
Figure 25:
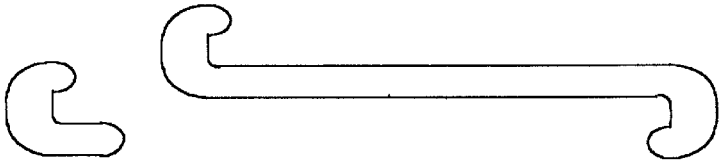
Figure 26:
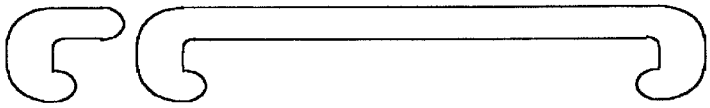
Figure 27:
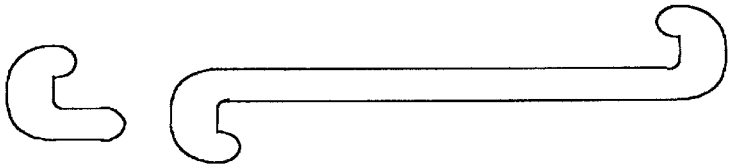
Figure 28:
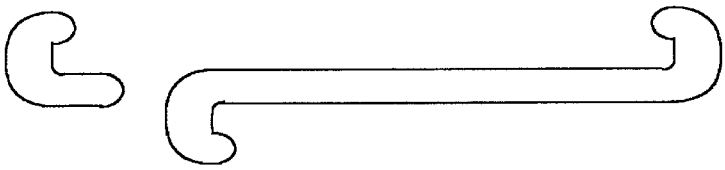
Figure 29:
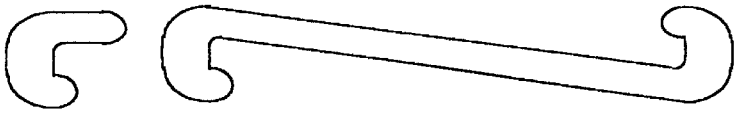
Figure 30:
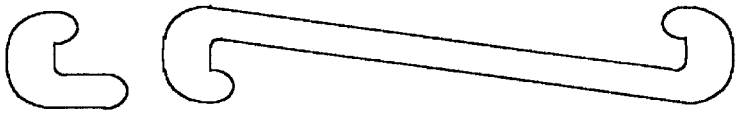
Figure 31:
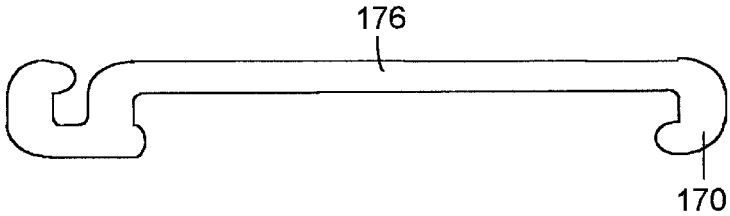
FIGS. 31–35 show alternative configurations of the longitudinal slot suitable for use in the third preferred embodiment of this invention.
Figure 32:
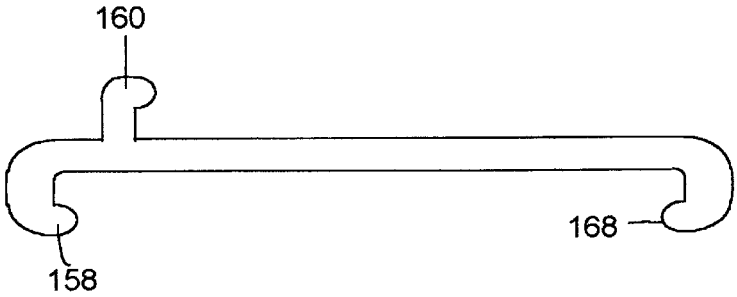
Figure 33:
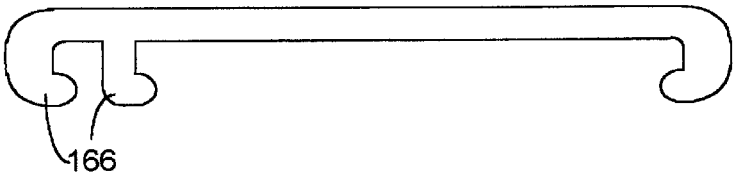
Figure 34:
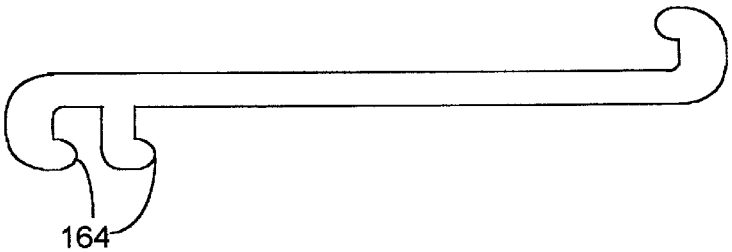
Figure 35:
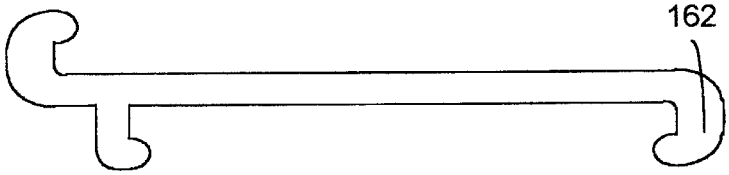

The present invention will now be described with reference to the above drawing. Like character numerals refer to like features throughout the description.

The first preferred embodiment will be described with reference to FIGS. 1,3–5, 10–12. and 14–17.

In the first preferred embodiment, the device 2 comprises a casing 4 having a top aspect 6, an inner surface 8, an outer surface 10, a forward end 12, and a rearward end 14. The casing 4 may have any cross-sectional configuration, although circular and hexagonal are preferred. The casing 4 may have a smooth outer surface 10 or may be textured for a better feel and more secure grip. Texture may be imparted by tooling or the presence of a cover, such as a rubber sheath. The casing 4 has a generally longitudinal extension/retraction slot 16 extending through it along the top aspect 6, which slot 16 is approximately ⅓–½ the length of the casing 4. The slot 16 has forward 18, medial 20, and rearward 22 laterally oriented latch openings, which are enlarged lateral openings in the slot 16. The latch openings 18 20 22 may be of any convenient shape, although rectangular and circular are preferred. The casing 4 is of such a size as to be comfortably held in the hand when being used as a writing implement or a turning tool. Thus, a length of between 12 and 16 cm and a diameter between 0.8 and 1.6 cm are preferred. The casing 4, as well as other components of the device 2, is made of any suitable material, such as metal, composite, or plastic, with stainless steel being preferred.

A front end tip 24 having a rearward base 26 and a forward apex 28 is removeably affixed to the forward end 12 of the casing 4. At the forward apex 28, there is a forward central axial opening 30. The forward end tip 24 may be solid or hollow, preferably solid. In the event it is solid, the central axial passageway 32 extends throughout the length of the forward end tip 24. The forward end tip 24 is removeably attached to the casing 4 in any convenient fashion. In a preferred embodiment, the thickness of the casing wall 4 at its forward end 12 is reduced to form a forward rim 34 and the central portion 36 of the forward end tip 24 is extended rearwardly allowing a nesting of the forward end tip 24 in the casing 4. The casing 4 and the forward end tip 24 may contain threads 38 and the forward end tip 24 may be screwed into the casing 4. Alternatively, 2–8 threaded holes may be present in the forward rim 34 of the casing 4 and the nested forward end tip 24 is held in place by bolts.

In a first embodiment, there is a barrier 40 fixedly attached within the casing 4 approximately one quarter of the distance from the forward end 12 to the rearward end 14 of the casing 4. The barrier 40 has a central axial passageway 32 of the same size and shape as that in the forward end tip 24. Fixation of the barrier 40 to the inner surface 8 of the casing 4 may be by welds, adhesives, rivets, bolts, or press fit.

A forward work piece 42, which may be an ink cartridge 44 or a tool rod 46, fits through the central axial passageway 32.

The forward work piece 42 has a forward end 48, a rearward end 50, and an outer surface 52.

When the forward work piece 42 is an ink cartridge 44, it has a writing point 54 at the forward end 48. In this alternative, the central axial passageway 32 in the forward end tip 24 and the barrier 40 are circular.

When the forward work piece 42 is a tool rod 46, the forward work piece 42 has a non-circular rod 56 and a turning tool 58 on at least one end thereof, preferably on both ends. In this alternative, the central axial passageway 32 in the forward end tip 24 and the barrier 40 is non-circular and has the same cross-sectional shape as the forward work piece 42.

A spring retainer 60 having a forward end 62 and a rearward end 64 protrudes radially outwardly from the outer surface 52 of the forward work piece 42. The forward work piece 42 fits in the forward portion of the device 2, passing through the central passageway 32 of the forward end tip 24 and the barrier 40. The cross-sectional size of the forward work piece 42 is such that it fits freely through this passageway without excessive play. The spring retainer 60 is so placed as to allow withdrawal of the forward work piece 42 from an extended position into the forward end tip 24 upon rearward movement of the forward work piece 42 before the forward work piece 42 is stopped by the abutment of the spring retainer 60 with the barrier 40.

A coil spring 66 having a forward end 68 and a rearward end 70 fits around the forward work piece 42 between the rearward base 26 of the forward end tip 24 and the spring retainer 60. The forward end 68 of the spring 66 rests against the rearward base 26 of the forward end tip 24 and the rearward end 70 of the spring 66 rests against the forward end 62 of the spring retainer 60. The purpose of the spring 66 is to urge the forward work piece 42 rearwardly.

A rearward endpiece 72 is attached to the rearward end 14 of the casing 4. Attachment may be in any convenient manner. The methods described for attaching the forward end tip 24 to the forward end 12 of the casing 4 are suitable. Inside the rearward endpiece 72 there is a smaller ring 74 which contains a non-circular central axial passageway 32. The ring 74 may be removably mounted in the rearward endpiece 72 by methods which will not allow turning of the rearward endpiece 72 or the ring 74 when torque is applied to the passageway 32. A preferred method is by the use of bolts 78. Alternatively, the rearward endpiece 72, including the portion surrounding the non-circular central axial passageway 32, may be of a single piece. In this event, the rearward endpiece 72 should not be connected to the casing 4 by means of threads. The central axial passageway 32 is non-circular so that a tool rod 76 will not slip upon the application of torque. The preferred shape is hexagonal, although any non-circular shape is suitable.

A tool rod 76 fits through the non-circular central axial passageway 32. The tool rod 76 contains a forward end 80 and a rearward end 82 with a turning tool 58 on at least one end. The turning tool 58 may be a Phillips head screwdriver, a flat head screwdriver, a torx, an Allen wrench, or other turning tool. Two separate turning tools 58 or different sized tools 58 of the same type may be used on the same tool rod 76. The cross-sectional size and shape of the tool rod 76 is such that the tool rod 76 fits freely through the non-circular passageway 32 without excessive play.

An extension/retraction pin 86 is located inside the casing 4 and is so sized as to slide along the inner surface 8 of the casing 4 and leaving a small space between the pin 86 and the inner surface 8 at the top aspect 6 of the casing 4. Subject to the features noted below, the pin 86 is of the same shape as the inner surface 8 of the casing 4. The pin 86 contains a flat forward end 88. The rearward end 90 of the pin 86 contains a central axial opening 92 having a forward end 94 to accept and abut with the forward end 80 of the tool rod 76. There is an extended space rearwardly of the forward end 94 of the central axial opening 92. The rearmost portion of this extended space contains a bushing 96, which creates a cylindrical extended space just forward of the bushing 96. This cylindrical extended space contains an O-ring 98 which applies a holding pressure against the tool rod 76. This pressure is such that the tool rod 76 will not be removed with light force, such as gravity, but will be removed with moderate force, such as a manually applied separation force.

Forwardly of the central axial opening 92, the pin 86 contains an actuator opening 100 having a side wall 102, a closed bottom end 104, and an open top end 106. The actuator opening 100 holds an actuator guide pin 108. The actuator opening 100 is laterally extended at the top 106 to form a seat 110 for the actuator guide pin 108. A coil actuator spring 112 having a top end 114 and a bottom end 116 fits into the actuator opening 100. The purpose of this spring 112 is to urge the actuator guide pin 108 upwardly. An actuator guide pin 108 having a side wall 118 having inner 120 and outer122 surfaces fits into the actuator opening 100 between the actuator spring 112 and the side wall 102 of the actuator opening 100. The actuator guide pin 108 contains a top piece 124 which contains a plurality of levels. An upper level 126 of the top piece 124 is of a size and shape to fit through the longitudinal extension/retraction slot 16. A medial level 128 of the top piece 124 is of a size and shape so as to fit within the latch openings 18 20 22 in the longitudinal extension/retraction slot 16. A lower level 130 of the top piece 124 is of such a size and shape that it is larger than the latch openings 18 20 22. When the actuator guide pin 108 is in a latch opening 18 20 22 in the longitudinal slot 16, the actuator guide pin 108 is urged upwardly by the actuator spring 112, forcing the medial level 128 of the top piece 124 into a latch opening 18 20 22. In this position, the actuator guide pin 108 is locked in the latch opening 18 20 22 and the extension/retraction pin 86 cannot be moved longitudinally in the longitudinal slot 16. When the actuator guide pin 108 is in the down position because of externally applied pressure, the medial level 128 becomes disengaged from the latch opening 18 20 22 in the longitudinal slot 16 and the extension/retraction pin 86 may be moved longitudinally within the extension/retraction slot 16. This movement allows the pin 86 to be moved to the forward latch opening 18, the medial latch opening 20, or the rearward latch opening 22.

When the extension/retraction pin 86 is in the forward latch opening 18, the forward work piece 42 is extended and the tool rod 76 is retracted. When the extension/retraction pin 86 is in the medial latch opening 20, both the forward work piece 42 and the tool rod 76 are retracted. When the extension/retraction pin 86 is in the rearward latch opening 22, the forward work piece 42 is retracted and the tool rod 76 is extended. Thus, the device 2 allows for quick, simple change between a turning tool 58 or writing point 54 carried on the forward work piece 42 and a turning tool 58 on the rearwardly positioned tool rod 76. The device 2 gives the appearance that the user is carrying a writing implement and avoids the appearance that the user is carrying a screwdriver or other tool.

The second preferred embodiment will now be described with reference to FIGS. 2 and 6–17.

The device 132 of the second preferred embodiment comprises a casing 4 which is the same as that of the first preferred embodiment except the casing 4 of the second preferred embodiment has forward 134 and rearward 136 longitudinal extension/retraction slots extending through it. The forward slot 134 has forward 138 and rearward 140 latch openings and the rearward slot 136 has forward 142 and rearward 144 latch openings, which are enlarged openings in the slots 134 136. Preferably these slots 134 136 are in a line, but any nonlinear relationship is satisfactory.

The forward end tip 24 of the second preferred embodiment is the same as that of the first preferred embodiment.

There is no barrier 40 in the second embodiment.

The forward work piece 42 of the second preferred embodiment, including the coil spring 66 and spring retainer 60, is the same as the forward work piece 42 of the device 2 of the first preferred embodiment.

The rearward endpiece 72 of the second embodiment is the same as that of the first embodiment.

The tool rod 76 of the second embodiment is the same as that of the first embodiment.

The device 132 of the second embodiment contains a forward extension/retraction pin 146 and a rearward extension/retraction pin 86 which are associated with the forward 134 and rearward 136 extension/retraction longitudinal slots, respectively.

The forward extension/retraction pin 146 is located inside the casing 4 and is so sized and shaped as to slide along the inner surface 8 of the casing leaving a small space between the forward extension/retraction pin 146 and the inner surface 8 adjacent the top aspect 6 of the casing 4. Subject to the features noted below, the forward extension/retraction pin 146 is of the same shape as the inner surface 8 of the casing 4. The forward extension/retraction pin 146 contains a flat rearward end 148. The forward end 150 of the forward extension/retraction pin 146 contains a central axial opening 152 having a forward end 154 to accept the rearward end 50 of the forward work piece 42. No bushing or holding O-ring is present. Rearwardly of the central axial opening 152 in the forward extension/retraction pin 146, the pin 146 contains an actuator opening 100 for an actuator guide pin 108. This actuator opening 100 with the associated coil actuator spring 112 and actuator guide pin 108 are the same as the corresponding latching mechanism in the first preferred embodiment. The forward extension/retraction pin 146 may be moved to the forward latch opening 138 or the rearward latch opening 140 of the forward extension/retraction slot 134. When the forward extension/retraction pin 146 is in the forward latch opening 138, the forward work piece 42 is extended and when the forward extension/retraction pin 146 is in the rearward latch opening 140, the forward work piece 42 is retracted.

The rearward extension/retraction pin 86 of the second embodiment is the same as that of the first embodiment. When the rearward extension/retraction pin 86 of the rearward extension/retraction slot 136 is in the forward latch opening 142, the tool rod 76 is retracted. When the rearward extension/retraction pin 86 is in the rearward latch opening 144, the tool rod 76 is extended.

Thus, the device 132 of the second embodiment allows for independent control of the forward work piece 42 and the tool rod 76.

The third preferred embodiment will now be described with reference to FIGS. 18, 19, and 31–35

The device 156 of the third preferred embodiment comprises a casing 4 which is the same as that of the first embodiment except the casing 4 of the third preferred embodiment contains forward 158, medial 160, and rearward 162 longitudinally oriented latch notches in place of the laterally oriented latch openings 18 20 22 of the first preferred embodiment. The latch notches 158 160 162 are positioned so that the forward and medial latch notches 158 160 each has a closed rearward aspect 164 and an open forward aspect 166 while the rearward latch notch 162 has a closed forward aspect 168 and an open rearward aspect 170.

The extension/retraction pin 172 of the third embodiment differs from that of the first embodiment in that it is simpler in construction and cheaper to manufacture.

The extension/retraction pin 172 of the third embodiment is located inside the casing 4 and is so sized as to slide along the inner surface 8 of the casing 4 and leaving a small space between the pin 172 and the inner surface 8 at the top aspect 6 of the casing 4. Subject to the features noted below, the pin 172 is of the same shape as the inner surface 8 of the casing 4. The pin 172 contains a flat forward end 88. The rearward end 90 of the pin 172 contains a central axial opening 92 having a forward end 94 to accept and abut with the forward end 80 of the tool rod 76. There is an extended space rearwardly of the forward end 94 of the central axial opening 92. The rearmost portion of this extended space contains a bushing 96, which creates a cylindrical extended space just forward of the bushing 96. This cylindrical extended space contains an O-ring 98 which applies a holding pressure against the tool rod 76. This pressure is such that the tool rod 76 will not be removed with light force, such as gravity, but will be removed with moderate force, such as a manually applied separation force.

A notch pin 174 is located forwardly of the central axial opening 92. The notch pin 174 is attached to the extension/retraction pin 172 in such a manner so that it protrudes from the extension/retraction pin 172, passes through the casing 4 and may be made to slide along the extension/retraction slot 176 with finger pressure. A preferred manner of attaching the notch pin 174 to the extension/retraction pin 172 is by means of a threaded hole 178 in the extension/retraction pin 172 and a bolt 180 which passes through the notch pin 174 and screws into the threaded hole 178.

The third embodiment further differs from the first embodiment in having a rearward coil spring 182. This coil spring 182 lies within the casing 4 just forward of the ring 74 within the rearward endpiece 72. This coil spring 182 exerts a forward pressure on the extension/retraction pin 172. Thus, if the notch pin 174 is in the forward latch notch 158, the forward spring 66 exerts a rearward pressure on it, holding it in place. In this condition, the forward work piece 42 is extended and the rearward tool rod 76 is retracted. Light finger pressure may be used to move the notch pin 174 from the forward latch notch 158 into the extension/retraction slot 176. If the notch pin 174 is moved to the medial latch notch 160, the forward spring 66 exerts a rearward pressure on it, holding it in place. In this condition, both the forward work piece 42 and the rearward tool rod 76 are retracted. Again, light finger action may be used to bring the notch pin 174 out of the medial latch notch 160 and slide it to the rearward latch notch 162. When the notch pin 174 is in the rearward latch notch 162, the rearward spring 182 exerts a forward pressure against the extension/retraction pin 172 to hold the notch pin 174 in place. In this condition, the forward work piece 42 is retracted and the rearward tool rod 76 is extended.

The generally longitudinal slot 176 may take a variety of shapes, such as those exemplified in FIGS. 31–35 as long as the forward 158 and medial 160 latch notches are open forwardly and the rearward latch notch 162 is open rearwardly.

The device of the fourth embodiment will now be described with reference to FIGS. 20–30.

The device 184 of the fourth preferred embodiment comprises a casing 4 which is the same as that of the second embodiment except the forward slot 186 of the casing 4 of the fourth preferred embodiment has forward 188 and rearward 190 longitudinally oriented latch notches and the rearward slot 192 has forward 194 and rearward 196 longitudinally oriented latch notches. The latch notches 188 190 194 196 are positioned so that the forward latch notch 188 194 in each slot 186 192 and the rearward latch notch 190 of the forward slot 186 has a closed rearward aspect 198 and an open forward aspect 200 while the rearward latch notch 196 in the rearward slot 192 has a closed forward aspect 202 and an open rearward aspect 204.

The forward end tip 24 of the fourth preferred embodiment is the same as that of the first, second, and third embodiments.

There is a barrier 40 in the fourth embodiment.

The forward work piece 42 of the fourth preferred embodiment, including the coil spring 66 and spring retainer 60, is the same as the forward work piece 42 of the first preferred embodiment.

The rearward endpiece 72 of the fourth embodiment is the same as that of the second embodiment.

The tool rod 76 of the fourth embodiment is the same as that of the second embodiment.

The device 184 of the fourth embodiment contains a forward extension/retraction pin 206 and a rearward extension/retraction pin 208 which are associated with the forward 186 and rearward 192 extension/retraction longitudinal slots, respectively.

The extension/retraction pins 206 208 of the fourth embodiment differ from those of the second embodiment in that they are simpler in construction and cheaper to manufacture.

The forward extension/retraction pin 206 is located inside the casing 4 and is so sized and shaped as to slide along the inner surface 8 of the casing 4 leaving a small space between the forward extension/retraction pin 206 and the inner surface 8 adjacent the top aspect 6 of the casing 4. Subject to the features noted below, the forward extension/retraction pin 206 is of the same shape as the inner surface 8 of the casing 4. The forward extension/retraction pin 206 contains a flat rearward end 148. The forward end 150 of the forward extension/retraction pin 206 is flat.

The rearward extension/retraction pin 208 of the fourth embodiment is located inside the casing 4 and is so sized as to slide along the inner surface 8 of the casing 4 and leaving a small space between the pin 208 and the inner surface 8 at the top aspect 6 of the casing 4. Subject to the features noted below, the pin 208 is of the same shape as the inner surface 8 of the casing 4. The pin 208 contains a flat forward end 88. The rearward end 90 of the pin 208 contains a central axial opening 92 having a forward end 94 to accept and abut with the forward end 80 of the tool rod 76 There is an extended space rearwardly of the forward end 94 of the central axial opening 92. The rearmost portion of this extended space contains a bushing 96, which creates a cylindrical extended space just forward of the bushing 96. This cylindrical extended space contains an O-ring 98 which applies a holding pressure against the tool rod 76 This pressure is such that the tool rod 76 will not be removed with light force, such as gravity, but will be removed with moderate force, such as a manually applied separation force.

The device 184 of the fourth embodiment contains forward 210 and rearward 212 notch pins connected to the forward 206 and rearward 208 extension/retraction pins in the same manner as disclosed relative to the third embodiment.

The fourth embodiment further differs from the second embodiment in having a rearward coil spring 214. This coil spring 214 lies within the casing 4 just forward of the ring 74 within the rearward endpiece 72. This coil spring 214 exerts a forward pressure on the rearward extension/retraction pin 208. Thus, if the forward notch pin 210 is in the forward latch notch 188 of the forward slot 186, the forward spring 66 exerts a rearward pressure on it, holding it in place. In this condition, the forward work piece 42 is extended. Light finger pressure may be used to move the notch pin 210 from the forward latch notch 188 into the forward extension/retraction slot 186. If the notch pin 210 is moved to the rearward notch 190 of the forward slot 186, the forward spring 66 exerts a rearward pressure on it, holding it in place. In this condition, the forward work piece 42 is retracted. When the rearward notch pin 212 is in the forward latch notch 194 of the rearward slot 192 the forward spring 66 exerts a rearward pressure on it, holding it in place. In this condition, the rearward tool rod 76 is retracted. When the rearward notch pin 212 of the rearward slot 192 is in the rearward latch notch 196, the rearward tool rod 76 is extended. In this condition, the rearward spring 214 exerts a forward pressure against the extension/retraction pin 208 to hold the notch pin 212 in place. Thus the forward work piece 42 may be extended or retracted independently of the position of the rearward extension/retraction pin 208.

The notch pin 210 for the forward extension/retraction pin 206 is located on the top aspect of the extension/retraction pin 206. The notch pin 212 for the rearward extension/retraction pin 208 is located on the top aspect forwardly of the central axial opening 92. The notch pins 210 212 are attached to the extension/retraction pins 206 208 in such a manner that they protrude from the extension/retraction pins 206 208, pass through the casing 4, and may be made to slide along the extension/retraction slots 186 192 with finger pressure. A preferred manner of attaching the notch pins 210 212 to the extension/retraction pins 206 208 is by means of threaded holes 178 in the extension/retraction pins 206 208 and bolts 180 which passes through the notch pins 210 212 and screw into the threaded holes 178.

Figure 36:
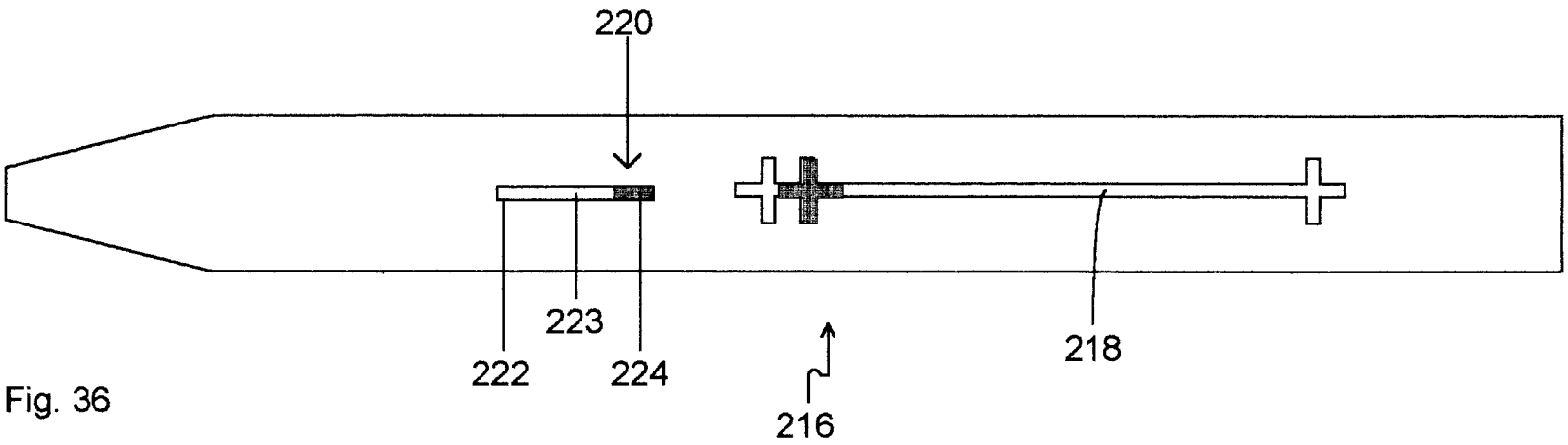
FIG. 36 is a top elevational view of the device according to the fifth preferred embodiment of this invention.
Figure 37:
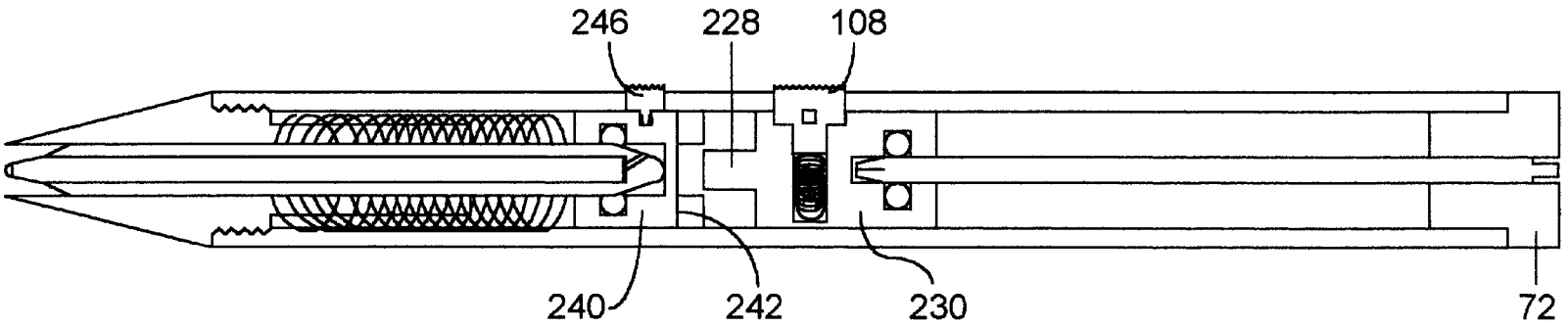
FIG. 37 is a longitudinal cross-sectional view of the device according to the fifth preferred embodiment of this invention.
Figure 38:
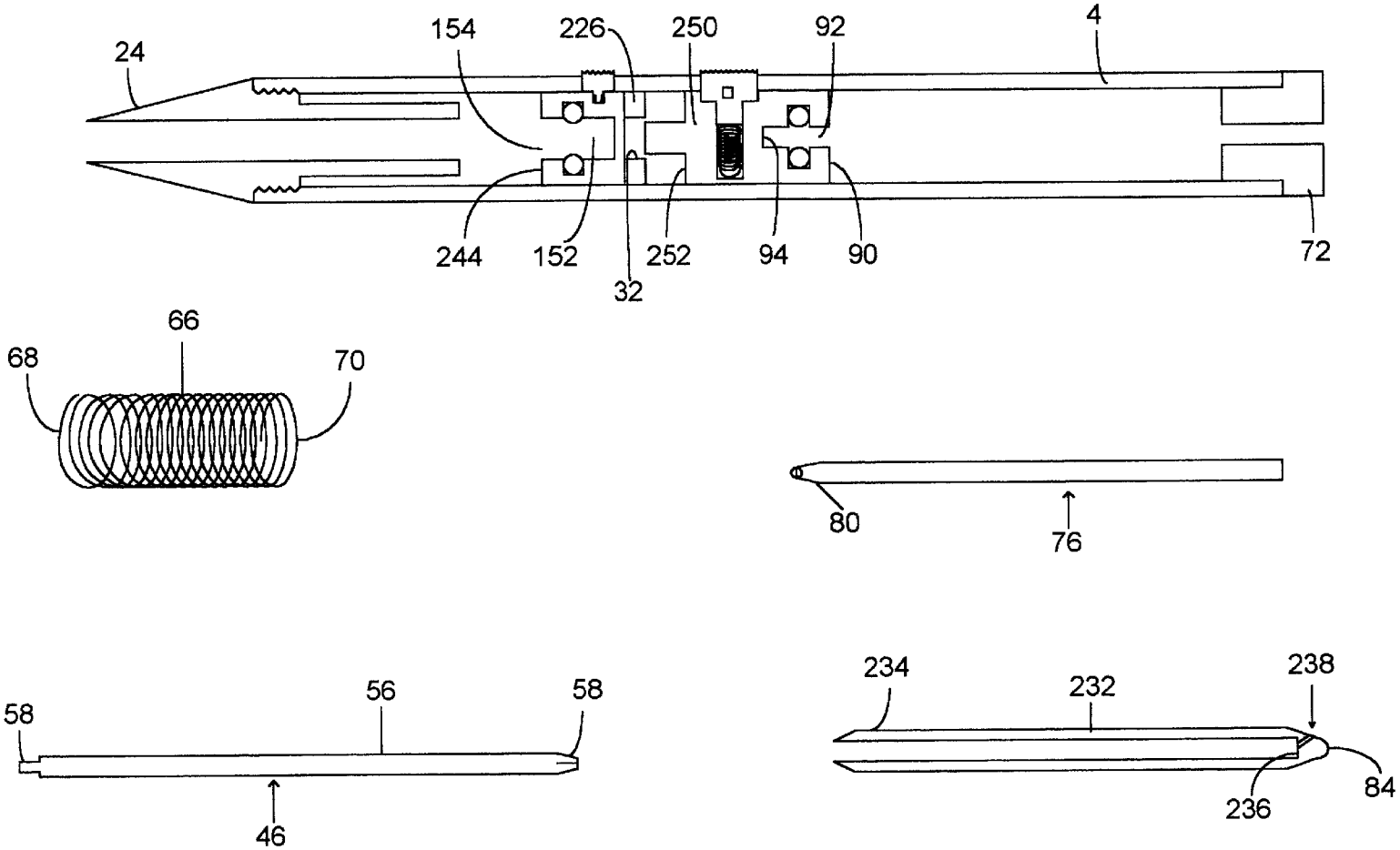
FIG. 38 is an exploded longitudinal cross-sectional view of the device according to the fifth preferred embodiment of this invention.

The device 216 of the fifth embodiment of this invention will now be described with reference to FIGS. 36–38.

In the fifth preferred embodiment, the device 216 comprises a casing 4 having a top aspect 6, an inner surface 8, an outer surface 10, a forward end 12, and a rearward end 14.

The casing 4 may have any cross-sectional configuration, although circular and hexagonal are preferred. The casing 4 may have a smooth outer surface 10 or may be textured for a better feel and more secure grip. Texture may be imparted by tooling or the presence of a cover, such as a rubber sheath. The casing 4 has a rearward primary generally longitudinal extension/retraction slot 218 extending through it along the top aspect 6, which slot 218 is approximately ⅓–½ the length of the casing 4. The slot 218 has forward 18, medial 20, and rearward 22 latch openings or latch notches 158 160 162, which are the same as in the first and third embodiments of this invention. The casing 4 has a forward secondary generally longitudinal extension/retraction slot 220 having forward 222, medial, 223 and rearward 224 positions which may be the same as the latch openings 138 140 or latch notch 188 described relative to the second and fourth embodiments of this invention or may not have any openings or notches. The casing 4 is of such a size as to be comfortably held in the hand when being used as a writing implement or a turning tool. Thus, a length of between 12 and 16 cm and a diameter between 0.8 and 1.6 cm are preferred. The casing 4, as well as other components of the device 216, is made of any suitable material, such as metal, composite, or plastic, with stainless steel being preferred.

The device 216 of the fifth preferred embodiment has a front end tip 24 which is the same as that of the first four embodiments.

There is a barrier 226 fixedly attached within the casing 4 approximately one quarter of the distance from the forward end 12 to the rearward end 14 of the casing 4. The barrier 226 has a central axial passageway 32 of a size and shape allowing for the passage of a later-described forward protrusion 228 of a rearward extension/retraction pin 230. Fixation of the barrier 226 to the inner surface 8 of the casing 4 may be by welds, adhesives, rivets, bolts, or press fit.

A forward work piece holder 232 having an open front end 234, a closed rear end 236, and an opening 238 for the inlet and outlet of air is situated along the central axis forwardly of the barrier 226. The forward work piece holder 232 is adapted to snugly hold the forward work piece 42.

The forward work piece 42 has a forward end 48, a rearward end 50, and an outer surface 52. The forward work piece 42 may be an ink cartridge 44 having a writing point 54 or turning tool piece 58 on the front end 48. In the event the front end 48 is a turning tool piece 58, there may be another turning tool piece 58 on the rearward end 50.

The forward work piece holder 232 fits in the forward portion of the device 216, passing freely through the central passageway 32 of the forward end tip 24 without excessive play and fits into, and is held by, the forward extension/retraction pin 240. The forward work piece holder 232 contains an open front end 234, a closed rear end 236, and an air inlet/outlet opening 238 to avoid the creation of a vacuum inside the forward work piece holder 232. The rearward end 84 of the forward work piece holder is tapered to form a rounded cone which is a stylus 84. The purpose of the stylus 84 is to key in pocket organizers or similar instruments which contain keys too small to be operated with the fingers. In order to enable the stylus 84, to etch glass, metal, or other material, there may be steel, carbide or diamond imbedded in it.

The forward extension/retraction pin 240 is located inside the casing 4 and is so sized and shaped as to slide along the inner surface 8 of the casing 4 leaving a small space between the forward extension/retraction pin 240 and the inner surface 8 adjacent the top aspect 6 of the casing 4. Subject to the features noted below, the forward extension/retraction pin 240 is of the same shape as the inner surface 8 of the casing 4. The forward extension/retraction pin 240 contains a flat rearward end 242. The forward end 244 of the forward extension/retraction pin 240 contains a central axial opening 152 having a forward end 154 to accept the rearward end 84 of the forward work piece holder 232. The forward extension/retraction pin 240 contains a bushing 96 and a holding O-ring 98 like that in the later-described rearward extension/retraction pin 230.

The forward extension/retraction pin 240 is connected to a control button 246 which is capable of sliding along the secondary forward longitudinal extension/retraction slot 220 between a forward position 222 and a rearward position 224.

When the forward extension/retraction pin 240 is in the forward position 222, the forward work piece holder 232 is extended, thus allowing the user to manually grasp the forward work piece holder 232, remove it from the central axial passageway 32, and reverse the forward work piece 42. When the extension/retraction pin 240 is in the rearward position 224, the forward work piece holder 232 is retracted.

If the control button 246 in the forward secondary longitudinal slot 220 is in the rearward position 224 and the actuator guide pin 108 or notch pin 174 is moved to the forward position 18 in the rearward primary slot 218, the forward work piece holder 232 will be pushed forward in the forward secondary longitudinal slot 220 so that it is in the intermediate position 223. In this position 223, the forward work piece holder 232 is extended and the writing point 54 or stylus 84 is operative.

A coil spring 66 having a forward end 68 and a rearward end 70 fits around the forward work piece holder 232 between the rearward base 26 of the forward end tip 24 and the forward end 244 of the forward extension/retraction pin 240. The purpose of the spring 66 is to urge the forward work piece holder 232 rearwardly.

The fifth embodiment has a rearward endpiece 72 which is the same as that of the first four embodiments.

The fifth embodiment has a rearward tool rod 76 which is the same as that of the first four embodiments.

A rearward extension/retraction pin 230 is located inside the casing 4 and is so sized as to slide along the inner surface 8 of the casing 4 and leaving a small space between the pin 230 and the inner surface 8 at the top aspect 6 of the casing 4. Subject to the features noted below, the pin 230 is of the same shape as the inner surface 8 of the casing 4. The pin 230 contains a forward end 250 which is flat at the periphery 252 and contains a centrally located protrusion 228 of such a size as to fit through the central axial passageway 32 of the barrier 226. The rearward end 90 of the pin 230 contains a central axial opening 92 having a forward end 94 to accept and abut with the forward end 80 of the tool rod 76. There is an extended space rearwardly of the forward end 94 of the central axial opening 92. The rearmost portion of this extended space contains a bushing 96, which creates a cylindrical extended space just forward of the bushing 96. This cylindrical extended space contains an O-ring 98 which applies a holding pressure against the tool rod 76. This pressure is such that the tool rod 76 will not be removed with light force, such as gravity, but will be removed with moderate force, such as a manually applied separation force.

Forwardly of the central axial opening 92 in the rearward extension/retraction pin 230, the pin 230 is connected to an actuator guide pin 108 or a notch pin 174 in the same manner as previously described.

When the extension/retraction pin 240 of the forward extension/retraction slot 220 is in the forward position 222, the forward work piece holder 232 is extended to a point which allows the forward work piece 232 holder to be grasped, removed from the central axial passageway 32, and allow the user to reverse the position of the forward work piece 42.

When the extension/retraction pin 240 of the forward extension/retraction slot 220 is in the intermediate position 223, the forward work piece holder 232 is extended to allow the writing point 54 or stylus 84 to be available.

When the extension/retraction pin 240 of the forward extension/retraction slot 220 is in the rearward position 224, the forward work piece holder 232 is retracted.

The coil spring 66 exerts a rearward pressure against the forward extension/retraction pin 240 to keep it pushed back against the barrier 226 or against the forward protrusion 228 of the rearward extension/retraction pin.

When the extension/retraction pin 230 of the rearward extension/retraction slot 218 is in the forward 18 or medial 20 opening or notch 158 160, the rearward tool rod 76 is retracted.

When the extension/retraction pin 230 of the rearward extension/retraction slot is 218 is the rearward opening 22 or notch 162, the rearward tool rod 76 is extended.

When the extension/retraction pin 240 of the forward extension/retraction slot 220 is in the rearward position 224, the forward work piece 42 or work piece holder 232 is retracted and is unavailable.

When the forward extension/retraction pin 240 of the forward extension/retraction slot 220 is the rearward position 224 and is then pushed forward by the forward protrusion 228 of the rearward extension/retraction pin 230, the forward extension/retraction pin 240 is moved to the intermediate position 223 of the forward extension/retraction slot 220. In this position, the forward work piece 42 or forward work piece holder 232 is extended to be operative.

When the extension/retraction pin 240 of the forward extension/retraction slot 220 is manually pushed forward to the forward position 222, the forward work piece holder 232 is extended beyond its normal operative position and is easily grasped and manually removed from the central axial passageway 32. Once removed, the position of the forward work piece 42 in the work piece holder 232 may be easily reversed. The opening 238 for the inlet and outlet of air prevents the formation of a vacuum and permits the removal of the forward work piece 42 from the forward work piece holder 232. Thus, changing from writing point 54 to stylus 84 or turning tool 58 can be done quickly and easily by reversing the direction of the work piece 42 or the work piece holder 232.

When the extension/retraction pin 230 of the rearward extension/retraction slot 218 is in the rearward opening 22 or notch 162, the tool rod 76 is extended.

Figure 39:
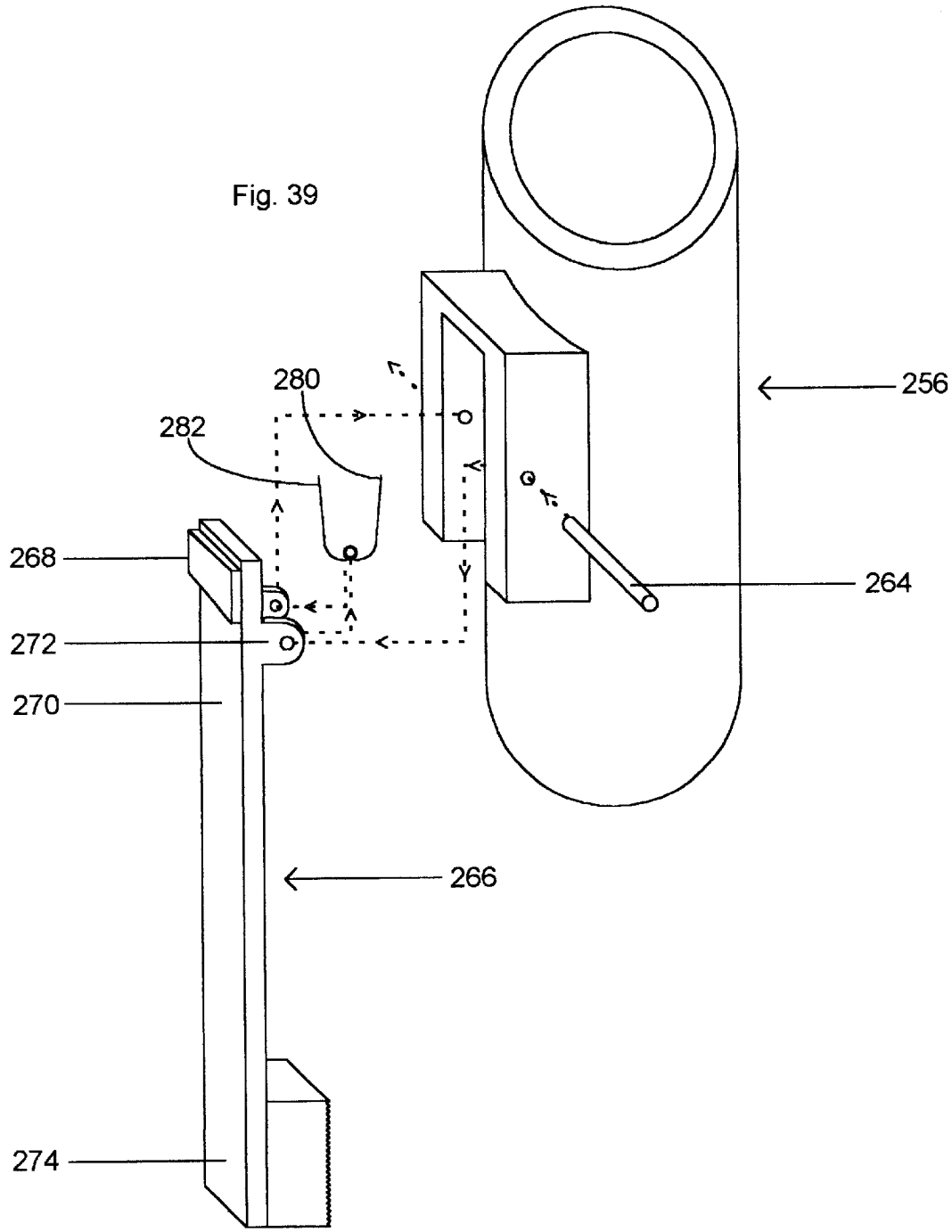
FIG. 39 shows an exploded elevational perspective view of pocket clip of the present invention showing a ring collar.
Figure 40:
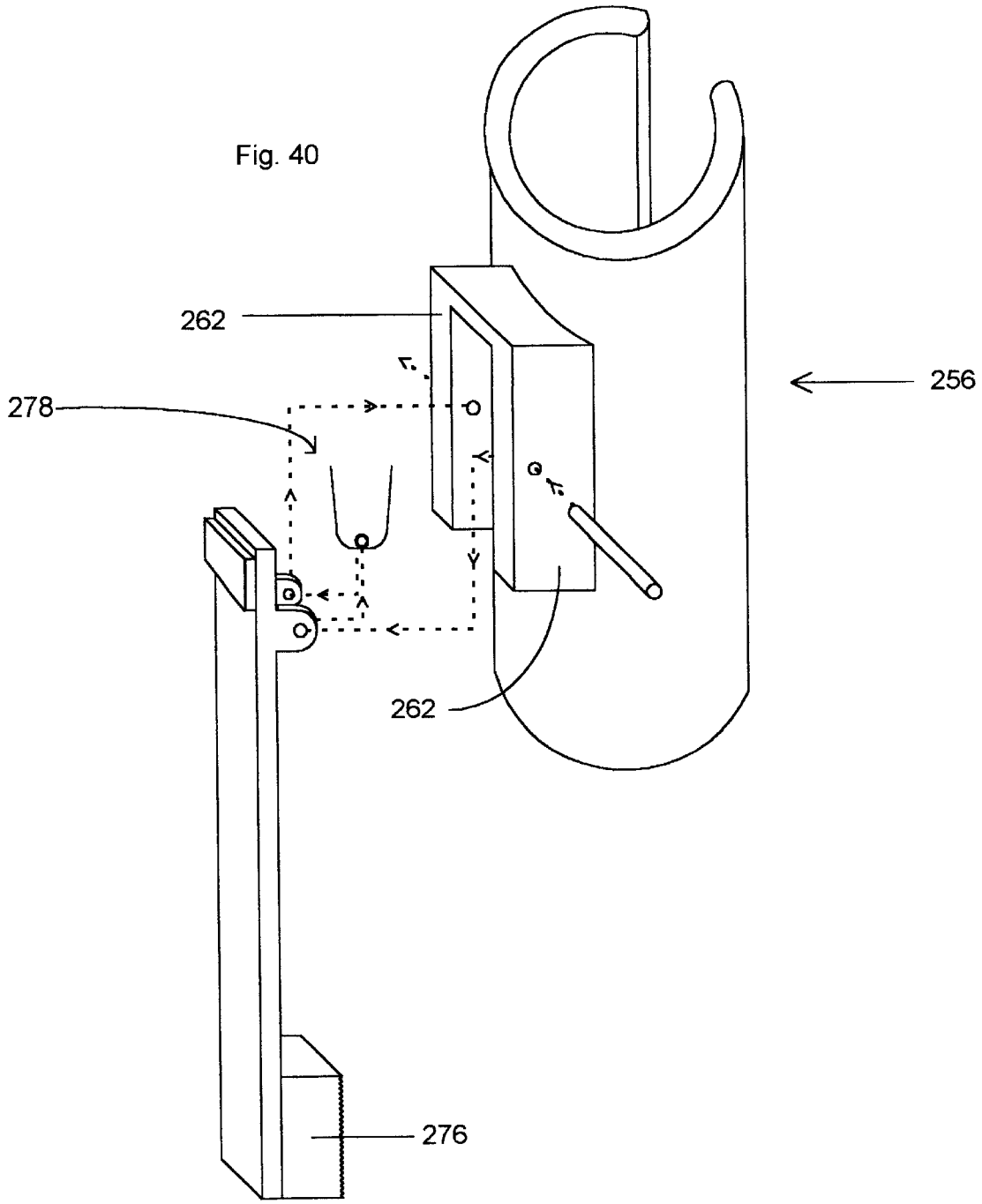
FIG. 40 is an exploded elevational perspective view of the pocket clip of the present invention showing a clip-on collar.
Figure 41:
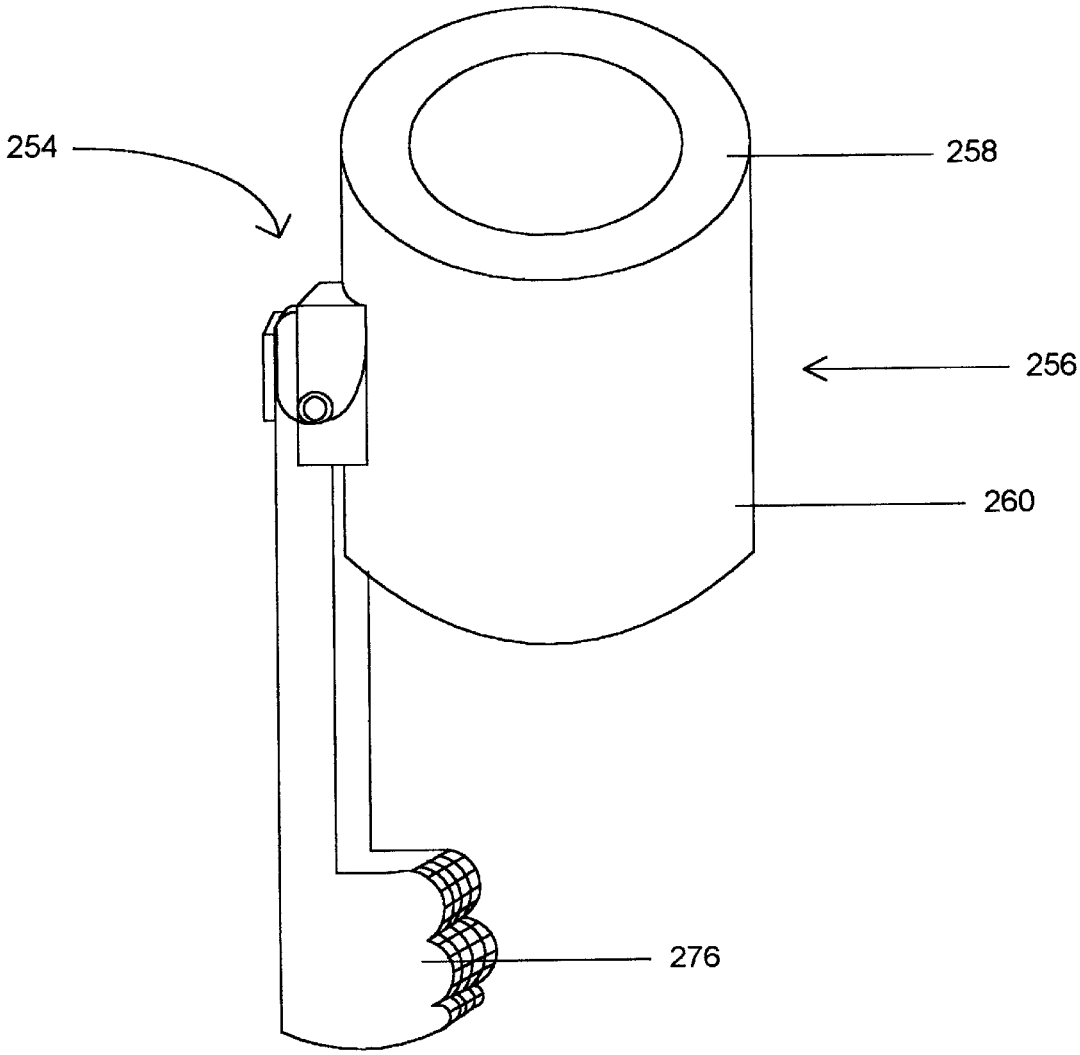
FIG. 41 is a pocket clip of the present invention showing the textured gripping head.

The device 2 132 156 184 216 of the present invention may be used as described above or it may be in combination with a pocket clip 254. Any conventional pocket clip 254 may be employed. However, the following clip 254, shown in FIGS. 39–41, is preferred.

The pocket clip 254 comprises a collar 256 containing an upper end 258 and a lower end 260 for fitting around the casing 4 of the device 2 132 156 184 216. Preferably, the collar 256 is a snap-on collar 256 to enable the clip 254 to fit around devices 2 132 156 184 216 having a range of sizes. Two parallel holding walls 262 extend outwardly from the collar 256. A pivot rod 264 extends between the two holding walls 262. A clip body 266 has an upper segment 268 capable of receiving external manual pressure. The clip body 266 has a middle segment 270 which has walls 272 which fit between the two holding walls 262 and which fit over, and pivot around, the pivot rod 264. The clip body 266 has a lower segment 274 which contains an extended, textured gripping head 276. A tension spring 278 having first 280 and second ends 282 is coiled around the pivot rod 264. The first end 280 of the spring 278 abuts the upper end 258 of the collar 256, and the second end 282 abuts the upper segment 268 of the clip body 266. When the upper segment 268 of the clip body 266 is manually pushed toward the collar 256 the lower segment 274 containing the gripping head 276 is pivoted away from the casing 4 allowing simple insertion into, and retraction from, a pocket of the device . When the upper segment 268 is released, the tension spring 278 forces the gripping head 276 toward the device 2 132 156 184 216 and ensures a tight grip on the pocket. Thus, use of this clip 254 results in a tight fit of the device 2 132 156 184 216 on a pocket, resulting in a lowered chance of losing the device 2 132 156 184 216 when the user bends over.

Obviously, numerous modifications and variations of the present invention are possible in light of the above teachings. It is therefore to be understood that within the scope of the appended claims, the invention may be practiced otherwise than as specifically described herein.

What is claimed is:

1. A device comprising:

a hollow casing of such dimensions as to be held in the hand, said casing having inner and outer surfaces, a forward end, a rearward end, and a longitudinal extension/retraction slot through the casing, which slot has forward, medial, and rearward latch openings;

a forward tip having a rearward base and a forward apex, the tip being affixed to the forward end of the casing, which tip contains a central axial passageway;

a barrier fixedly located inside the casing approximately one quarter of the distance from the forward end to the rearward end, which barrier contains a central axial passageway;

a forward work piece which is a member selected from the group consisting of 1) an ink cartridge having a forward end, a rearward end, an outer surface, and a writing point at the forward end, 2) a stylus, and 3) a tool rod having a forward end, a rearward end, an outer surface and a turning tool on at least one end, wherein the forward work piece has a spring retainer protruding radially outwardly from the outer surface of the forward work piece, the forward work piece being of such size as to fit freely through the central axial passageways in the tip and the barrier without excessive play;

a coil spring around the forward work piece, which coil spring has a forward end and a rearward end, the forward end of the spring resting against the rearward base of the tip and the rearward end of the spring resting against the spring retainer, which spring urges the forward work piece rearwardly;

a rearward endpiece affixed to the rearward end of the casing, which rearward endpiece contains a non-circular central axial passageway;

a rearward tool rod containing a forward end, a rearward end, and a turning tool on at least one end, the tool rod being of such a size as to fit freely through the central axial passageway of the rearward endpiece without excessive play; and an extension/retraction pin located inside the casing and so sized as to slide along the inner surface of the casing, which pin contains a flat forward end and a rearward end, the rearward end being open and adapted to receive and hold the forward end of the rearward tool rod, the extension/retraction pin having an actuator guide pin springmounted therein in such a manner that when the actuator guide pin is depressed, the extension/retraction pin may be moved longitudinally along the extension/retraction slot in the casing to extend or retract the forward work piece through the central passageway in the forward tip and to extend or retract the rearward tool rod through the central axial passageway in the rearward endpiece and in such a manner that when the actuator guide pin is raised, the actuator guide pin must remain in a forward, medial, or rearward latch opening in the extension/retraction slot.

2. The device of claim 1, wherein the turning tool is at least one of a Phillips head screwdriver, a flat head screwdriver, a torx, or an Allen wrench.

3. The device of claim 1, wherein the forward work piece is an ink cartridge.

4. A combination comprising the device of claim 1 in combination with a pocket clip, wherein the pocket clip comprises a collar fitting around the casing of the device, two parallel holding walls extending outwardly from the collar, a pivot rod extending between the two holding walls, a clip body having an upper segment capable of receiving external manual pressure, a middle segment which has walls which fit over, and pivot around, the pivot rod, and a lower segment which contains a textured gripping head, and a spring having two ends, which spring is coiled around the pivot rod, the first end of the spring abuts the collar and the second end of the spring abuts the upper segment of the clip body.

5. A device comprising:

a hollow casing of such dimensions as to be held in the hand, said casing having inner and outer surfaces, a forward end, a rearward end, a forward longitudinal extension/retraction slot through the casing, which slot has forward and rearward latch openings and a rearward longitudinal extension/retraction slot through the casing, which slot has forward and rearward latch openings;

a forward tip having a rearward base and a forward apex, the tip being affixed to the forward end of the casing, which tip contains a central axial passageway;

a forward work piece which is a member selected from the group consisting of 1) an ink cartridge having a forward end, a rearward end, an outer surface, and a writing point at the forward end, 2) a stylus, and 3) a tool rod having a forward end, a rearward end, an outer surface and a turning tool on at least one end, wherein the forward work piece has a spring retainer protruding radially outwardly from the outer surface of the forward work piece, the forward work piece being of such size as to fit freely through the central axial passageways in the tip and the barrier without excessive play;

a coil spring around the forward work piece, which coil spring has a forward end and a rearward end, the forward end of the spring resting against the rearward base of the tip and the rearward end of the spring resting against the spring retainer, which spring urges the forward work piece rearwardly; p1 a rearward endpiece affixed to the rearward end of the casing, which rearward endpiece contains a non-circular central axial passageway;

a rearward tool rod containing a forward end, a rearward end, and a turning tool on at least one end, the tool rod being of such a size as to fit freely through the central axial passageway of the rearward endpiece without excessive play;

a forward extension/retraction pin located inside the casing and so sized as to slide along the inner surface of the casing, which pin contains an open forward end adapted to receive the rearward end of the forward work piece and a flat rearward end;

a rearward extension/retraction pin located inside the casing and so sized as to slide along the inner surface of the casing, which pin contains a flat forward end and a rearward end, the rearward end being open and adapted to receive and hold the forward end of the rearward tool rod; and each of the extension/retraction pins having an actuator guide pin spring-mounted therein in such a manner that when an actuator guide pin is depressed, the corresponding extension/retraction pin may be moved longitudinally along the corresponding extension/retraction slot in the casing to extend or retract the forward work piece through the central axial passageway in the forward tip or to extend or retract the rearward tool rod through the central axial passageway in the rearward endpiece and in such a manner that when the actuator guide pin is raised, the actuator guide pin must remain in a forward or rearward latch opening in the corresponding extension/retraction slot.

6. The device of claim 5, wherein the turning tool is at least one of a Phillips head screwdriver, a flat head screwdriver, a torx, or an Allen wrench.

7. The device of claim 5, wherein the forward work piece is an ink cartridge.

8. A combination comprising the device of claim 5 in combination with a pocket clip, wherein the pocket clip comprises a collar fitting around the casing of the device, two parallel holding walls extending outwardly from the collar, a pivot rod extending between the two holding walls, and a clip body having an upper segment capable of receiving external manual pressure, a middle segment which has walls which fit over, and pivot around, the pivot rod, and a lower segment which contains a textured gripping head and a spring having two ends, which spring is coiled around the pivot rod, the first end of the spring abuts the collar and the second end of the spring abuts the upper segment of the clip body.

9. A device comprising:

a hollow casing of such dimensions as to be held in the hand, said casing having inner and outer surfaces, a forward end, a rearward end, and a generally longitudinal extension/retraction slot through the casing, which slot provides forward, medial, and rearward latch notches, the forward and medial latch notches having open forward aspects and closed rear aspects, and the rearward latch notch having a closed forward aspect and an open rearward aspect;

a forward tip having a rearward base and a forward apex, the tip being affixed to the forward end of the casing, which tip contains a central axial passageway;

a barrier fixedly located inside the casing approximately one quarter of the distance from the forward end to the rearward end, which barrier contains a central axial passageway;

a forward work piece which is a member selected from the group consisting of 1) an ink cartridge having a forward end, a rearward end, an outer surface, and a writing point at the forward end, 2) a stylus, and 3) a tool rod having a forward end, a rearward end, an outer surface and a turning tool on at least one end, wherein the forward work piece has a spring retainer protruding radially outwardly from the outer surface of the forward work piece, the forward work piece being of such size as to fit freely through the central axial passageways in the tip and the barrier without excessive play;

a coil spring around the forward work piece, which coil spring has a forward end and a rearward end, the forward end of the spring resting against the rearward base of the tip and the rearward end of the spring resting against the spring retainer, which spring urges the forward work piece rearwardly;

a rearward endpiece affixed to the rearward end of the casing, which rearward endpiece contains a non-circular central axial passageway;

a rearward tool rod containing a forward end, a rearward end, and a turning tool on at least one end, the tool rod being of such a size as to fit freely through the central axial passageway of the rearward endpiece without excessive play;

an extension/retraction pin located inside the casing and so sized as to slide along the inner surface of the casing, which extension/retraction pin contains a flat forward end and a rearward end, the rearward end being open and adapted to receive and hold the forward end of the rearward tool rod, the extension/retraction pin having a latch notch pin attached thereto in such a manner that when the latch notch pin is forced out of a latch notch, the extension/retraction pin may be moved along the extension/retraction slot in the casing to extend or retract the forward work piece through the central passageway in the forward tip and to extend or retract the rearward tool rod through the central axial passageway in the rearward endpiece and in such a manner that when the latch notch pin is allowed to move into a latch notch, the latch notch pin must remain in that notch; and a rearward coil spring located between the rearward endpiece and the extension/retraction pin, which coil spring exerts forward pressure on the extension/retraction pin.

10. The device of claim 9, wherein the turning tool is at least one of a Phillips head screwdriver, a flat head screwdriver, a torx, or an Allen wrench.

11. The device of claim 9, wherein the forward work piece is an ink cartridge.

12. A combination comprising the device of claim 9 in combination with a pocket clip, wherein the pocket clip comprises a collar fitting around the casing of the device, two parallel holding walls extending outwardly from the collar, a pivot rod extending between the two holding walls, a clip body having an upper segment capable of receiving external manual pressure, a middle segment which has walls which fit over, and pivot around, the pivot rod, and a lower segment which contains a textured gripping head, and a spring having two ends, which spring is coiled around the pivot rod, the first end of the spring abuts the collar and the second end of the spring abuts the upper segment of the clip body.

13. A device comprising:

a hollow casing of such dimensions as to be held in the hand, said casing having inner and outer surfaces, a forward end, a rearward end, a forward generally longitudinal extension/retraction slot through the casing, which slot provides forward and rearward latch notches and a rearward generally longitudinal extension/retraction slot through the casing, which slot provides forward and rearward latch notches, the forward latch notches having open forward aspects and closed rear aspects, and the rearward latch notches having a closed forward aspect and an open rearward aspect, a forward tip having a rearward base and a forward apex, the tip being affixed to the forward end of the casing, which tip contains a central axial passageway;

a forward work piece which is a member of the group consisting of 1) an ink cartridge having a forward end, a rearward end, an outer surface, and a writing point at the forward end, 2) a stylus, and 3) a tool rod having a forward end, a rearward end, an outer surface and a turning tool on at least one end, wherein the forward work piece has a spring retainer protruding radially outwardly from the outer surface of the forward work piece, the forward work piece being of such size as to fit freely through the central axial passageways in the forward tip and the barrier without excessive play;

a coil spring around the forward work piece, which coil spring has a forward end and a rearward end, the forward end of the spring resting against the rearward base of the tip and the rearward end of the spring resting against the spring retainer, which spring urges the forward work piece rearwardly;

a rearward endpiece affixed to the rearward end of the casing, which rearward endpiece contains a non-circular central axial passageway;

a rearward tool rod containing a forward end, a rearward end, and a turning tool on at least one end, the tool rod being of such a size as to fit freely through the central axial passageway of the rearward endpiece without excessive play;

a forward extension/retraction pin located inside the casing and so sized as to slide along the inner surface of the casing, which pin contains a flat forward end and a flat rearward end;

a rearward extension/retraction pin located inside the casing and so sized as to slide along the inner surface of the casing, which pin contains a flat forward end and a rearward end, the rearward end being open and adapted to receive and hold the forward end of the rearward tool rod;

each of the extension/retraction pins having a latch pin attached thereto in such a manner that when a latch pin is forced out of a latch notch, the corresponding extension/retraction pin may be moved longitudinally along the corresponding extension/retraction slot in the casing to extend or retract the forward work piece through the central axial passageway in the forward tip or to extend or retract the rearward tool rod through the central axial passageway in the rearward endpiece and in such a manner that when the latch pin is allowed to move into a latch notch, the latch pin must remain in that notch; and a rearward coil spring located between the rearward endpiece and the rearward extension/retraction pin, which coil spring exerts forward pressure on the rearward extension/retraction pin.

14. The device of claim 13, wherein the turning tool is at least one of a Phillips head screwdriver, a flat head screwdriver, a torx, or an Allen wrench.

15. The device of claim 13, wherein the forward work piece is an ink cartridge.

16. A combination comprising the device of claim 13 in combination with a pocket clip, wherein the pocket clip comprises a collar fitting around the casing of the device, two parallel holding walls extending outwardly from the collar, a pivot rod extending between the two holding walls, and a clip body having an upper segment capable of receiving external manual pressure, a middle segment which has walls which fit over, and pivot around, the pivot rod, and a lower segment which contains a textured gripping head and a spring having two ends, which spring is coiled around the pivot rod, the first end of the spring abuts the collar and the second end of the spring abuts the upper segment of the clip body.

17. A device comprising:

a hollow casing of such dimensions as to be held in the hand, said casing having inner and outer surfaces, a forward end, a rearward end, a forward generally longitudinal extension/retraction slot through the casing, which slot provides forward, intermediate and rearward positions and a rearward generally longitudinal extension/retraction slot through the casing, which slot provides forward, medial, and rearward latch openings or latch notches, the forward and medial latch notches having open forward aspects and closed rear aspects, and the rearward latch notch having a closed forward aspect and an open rearward aspect;

a rearward endpiece affixed to the rearward end of the casing, which rearward endpiece contains a non-circular central axial passageway;

a rearward tool rod containing a forward end, a rearward end, and a turning tool on at least one end, the tool rod being of such a size as to fit freely through the central axial passageway of the rearward endpiece without excessive play;

a forward tip having a rearward base and a forward apex, the tip being affixed to the forward end of the casing, which tip contains a central axial passageway;

a forward work piece which is a member of the group consisting of 1) an ink cartridge having a forward end, a rearward end, an outer surface, and a writing point at the forward end and 2) a tool rod having a forward end, a rearward end, an outer surface and a turning tool on at least one end;

a barrier affixed to the inner surface of the casing, said barrier having a central axial passageway;

a forward work piece holder having an open front end, a closed rear end, and an opening for the inlet and outlet of air fitted in the casing along the central axis forwardly of the barrier, said work piece holder having a tapered conical rearward end which serves as a stylus or as an etching tool;

a forward extension/retraction pin located inside the casing forwardly of the barrier; and so sized as to slide along the inner surface of the casing, which pin contains an open forward end adapted to receive the rearward end of the forward work piece holder, a flat rearward end, and a control button mounted thereon in such a manner that the control button may be moved longitudinally along the forward extension/retraction slot in the casing to 1) retract the forward work piece holder so that the forward work piece is not available, 2) extend the forward work piece holder so that the forward work piece is available, or 3) extend the forward work piece holder to such an extent that it may be grasped manually and removed from the central axial passageway of the forward tip;

a coil spring around the forward work piece holder, which coil spring has a forward end and a rearward end, the forward end of the spring resting against the rearward base of the tip and the rearward end of the spring resting against the forward end of the forward extension/retraction pin; and a rearward extension/retraction pin located inside the casing and so sized as to slide along the inner surface of the casing, which pin contains a forward end having a flat periphery and a central protrusion, a rearward end which is open and adapted to receive and hold the forward end of the rearward tool rod, and an actuator guide pin or latch pin mounted therein in such a manner that the actuator guide pin or latch pin may be moved longitudinally along the rearward extension/retraction slot in the casing to extend or retract the rearward tool piece through the central passageway in the rearward tip and to extend the forward protrusion of the rearward extension/retraction pin through the central axial hole in the barrier to contact and push forward the forward extension/retraction pin.

18. The device of claim 17, wherein the turning tool is at least one of a Phillips head screwdriver, a flat head screwdriver, a torx, or an Allen wrench.

19. The device of claim 17, wherein the forward work piece comprises an ink cartridge.

20. A combination comprising the device of claim 17 in combination with a pocket clip, wherein the pocket clip comprises a collar fitting around the casing of the device, two parallel holding walls extending outwardly from the collar, a pivot rod extending between the two holding walls, and a clip body having an upper segment capable of receiving external manual pressure, a middle segment which has walls which fit over, and pivot around, the pivot rod, and a lower segment which contains a textured gripping head and a spring having two ends, which spring is coiled around the pivot rod, the first end of the spring abuts the collar and the second end of the spring abuts the upper segment of the clip body.

* * * * *